US007936328B2

(12) United States Patent
Furihata et al.

(10) Patent No.: US 7,936,328 B2
(45) Date of Patent: May 3, 2011

(54) DISPLAY PANEL INCLUDING AMPLIFIER WITH OFFSET CANCELING BY REVERSING POLARITY OF AMPLIFIER OFFSET

(75) Inventors: Hirobumi Furihata, Kanagawa (JP); Takashi Nose, Kanagawa (JP); Kouichi Nishimura, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 884 days.

(21) Appl. No.: 11/676,189

(22) Filed: Feb. 16, 2007

(65) Prior Publication Data

US 2009/0021462 A1 Jan. 22, 2009

(30) Foreign Application Priority Data

Feb. 17, 2006 (JP) ..... 2006-040360

(51) Int. Cl.
*G09G 3/36* (2006.01)

(52) U.S. Cl. ..... 345/96; 345/89

(58) Field of Classification Search ..... 345/88, 345/89, 96

See application file for complete search history.

(56) References Cited

U.S. PATENT DOCUMENTS

| | | | | |
|---|---|---|---|---|
| 7,319,450 | B2 * | 1/2008 | Choi | 345/89 |
| 7,474,306 | B2 * | 1/2009 | Doi et al. | 345/204 |
| 7,605,806 | B2 * | 10/2009 | Chen et al. | 345/690 |
| 2005/0162369 | A1 * | 7/2005 | Kim et al. | 345/98 |

FOREIGN PATENT DOCUMENTS

| | | | |
|---|---|---|---|
| CN | 1361910 | A | 7/2002 |
| CN | 1504986 | A | 6/2004 |
| JP | 2004-279482 | A | 10/2004 |

* cited by examiner

*Primary Examiner* — Chanh Nguyen
*Assistant Examiner* — Adam J Snyder
(74) *Attorney, Agent, or Firm* — Sughrue Mion, PLLC

(57) ABSTRACT

A data driver used for driving a display panel is provided with a grayscale voltage generator circuit generating a plurality of grayscale voltages; and a drive circuitry selecting a selected grayscale voltage from the plurality of grayscale voltages in response to input display data, and outputting a data signal having a voltage level corresponding to the selected grayscale voltage to the display panel. The grayscale voltage generator circuit comprises an amplifier generating a voltage bias; and a voltage generator circuit generating the plurality of grayscale voltages from the voltage bias. The amplifier is designed so that a polarity of an offset voltage of the amplifier is reversible. The polarity of the offset voltage of the amplifier is controlled so that the polarity of the offset voltage of the amplifier used for driving a specific pixel of the display panel in a certain frame period is opposite to that of the offset voltage of the amplifier used for driving the c specific pixel in another frame period.

13 Claims, 24 Drawing Sheets

| FRAME | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| POLARITY | + | − | + | − | + | − | + | − | + | − | + | − | + | − | + | − |
| FRC ERROR | 3 | 1 | 0 | 2 | 1 | 3 | 2 | 0 | 3 | 1 | 0 | 2 | 1 | 3 | 2 | 0 |
| COLOR-REDUCED DATA | 2 | 2 | 1 | 2 | 2 | 2 | 2 | 1 | 2 | 2 | 1 | 2 | 2 | 2 | 2 | 1 |
| ERROR OF DATA SIGNAL VOLTAGE LEVEL | +a | +d | −b | −d | +a | +d | −a | −d | −a | −d | +b | +d | −a | −d | +a | +c |

| FRAME | 1 | 2 | 3 | 4 | 5 | 6 | 7 | 8 |
|---|---|---|---|---|---|---|---|---|
| POLARITY | + | − | + | − | + | − | + | − |
| DISPLAY DATA | 2 | 2 | 2 | 2 | 2 | 2 | 2 | 2 |
| ERROR OF DATA SIGNAL VOLTAGE LEVEL | +a | +d | −a | −d | +a | +d | −a | −d |

| FRAME | 1 | 2 | 3 | 4 | 5 | 6 | 7 | 8 |
|---|---|---|---|---|---|---|---|---|
| POLARITY | + | − | + | − | + | − | + | − |
| DISPLAY DATA | 2 | 2 | 2 | 2 | 2 | 2 | 2 | 2 |
| ERROR OF DATA SIGNAL VOLTAGE LEVEL | +a' | +d' | −a' | −d' | +a' | +d' | −a' | −d' |

| FRAME | 1 | 2 | 3 | 4 | 5 | 6 | 7 | 8 |
|---|---|---|---|---|---|---|---|---|
| POLARITY | + | − | + | − | + | − | + | − |
| FRC ERROR | 1 | 3 | 2 | 0 | 3 | 1 | 0 | 2 |
| COLOR-REDUCED DATA | 2 | 2 | 2 | 1 | 2 | 2 | 1 | 2 |
| ERROR OF DATA SIGNAL VOLTAGE LEVEL | +a | +d | −a | −c | +a | +d | −b | −d |

| FRAME | 1 | 2 | 3 | 4 | 5 | 6 | 7 | 8 |
|---|---|---|---|---|---|---|---|---|
| POLARITY | + | − | + | − | + | − | + | − |
| FRC ERROR | 1 | 3 | 2 | 0 | 3 | 1 | 0 | 2 |
| COLOR-REDUCED DATA | 2 | 2 | 2 | 1 | 2 | 2 | 1 | 2 |
| ERROR OF DATA SIGNAL VOLTAGE LEVEL | +a' | +d' | −a' | −c' | +a' | +d' | −b' | −d' |

| FRAME | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| POLARITY | + | − | + | − | + | − | + | − | + | − | + | − | + | − | + | − |
| FRC ERROR | 3 | 1 | 0 | 2 | 1 | 3 | 2 | 0 | 3 | 1 | 0 | 2 | 1 | 3 | 2 | 0 |
| COLOR-REDUCED DATA ERROR OF DATA SIGNAL VOLTAGE LEVEL | 2 | 2 | 1 | 2 | 2 | 2 | 2 | 1 | 2 | 2 | 1 | 2 | 2 | 2 | 2 | 1 |
| | +a | +d | −b | −d | +a | +d | −a | −d | −a | −d | +b | +d | −a | −d | +a | +c |

| FRAME | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| POLARITY | + | − | + | − | + | − | + | − | + | − | + | − | + | − | + | − |
| FRC ERROR | 3 | 1 | 0 | 2 | 1 | 3 | 2 | 0 | 3 | 1 | 0 | 2 | 1 | 3 | 2 | 0 |
| COLOR-REDUCED DATA | 2 | 2 | 1 | 2 | 2 | 2 | 2 | 1 | 2 | 2 | 1 | 2 | 2 | 2 | 2 | 1 |
| ERROR OF DATA SIGNAL VOLTAGE LEVEL | +a' | +d' | −b' | −d' | +a' | +d' | −a' | −c' | −a' | −d' | +b' | +d' | −a' | −d' | +a' | +c' |

| FRAME | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| INPUT DISPLAY DATA (8 bits) | 7 | 7 | 7 | 7 | 7 | 7 | 7 | 7 | 7 | 7 | 7 | 7 | 7 | 7 | 7 | 7 |
| POLARITY OF DATA SIGNAL | + | − | + | − | + | − | + | − | + | − | + | − | + | − | + | − |
| FRC ERROR | 3 | 1 | 0 | 2 | 1 | 3 | 2 | 0 | 2 | 0 | 3 | 1 | 0 | 2 | 1 | 3 |
| COLOR-REDUCED DATA (6 bits) | 2 | 2 | 1 | 2 | 1 | 2 | 2 | 2 | 2 | 1 | 2 | 2 | 1 | 2 | 2 | 2 |

DISPLAY PANEL INCLUDING AMPLIFIER WITH OFFSET CANCELING BY REVERSING POLARITY OF AMPLIFIER OFFSET

BACKGROUND OF THE INVENTION

1. Field of the Invention

The present invention is related to a display device, data driver, and display drive method, and more particularly, to generation of data signals fed to respective pixels, from grayscale voltages which correspond to respective grayscale levels.

2. Description of the Related Art

Within a display device with a large display panel, the display panel is often driven by a plurality of data drivers. In such a display device, the display panel is divided into a plurality of regions, the number of which is identical to that of the data drivers, and the respective regions are respectively driven by the associated data drivers.

FIG. 1 is a block diagram illustrating a typical structure of a such-designed liquid crystal display device. The liquid crystal display device of FIG. 1 is provided with a liquid crystal display panel 101, a plurality of data drivers $\mathbf{102}_1$ to $\mathbf{102}_N$, a plurality of gate drivers 103, a grayscale generation power supply circuit 104, and a timing controller 105. The liquid crystal display panel 101 is divided into a plurality of regions $\mathbf{106}_1$ to $\mathbf{106}_N$, and each region $\mathbf{106}_i$ is connected with the associated data driver $\mathbf{102}_i$.

Each data driver $\mathbf{102}_i$ generates data signals having voltage levels corresponding to display data received from the timing controller 105, and thereby drives signal lines (or data lines) within the associated region $\mathbf{106}_i$ of the liquid crystal display panel 101. The operation timing of the data drivers 102 is controlled by display timing control signals (including a polarity signal, a shift pulse, and a latch signal and so on).

The gate driver 103 drives scan lines (or gate lines) within the liquid crystal display panel 104 in response to gate driver timing control signals (including a vertical sync signal and so on).

The timing controller 105 provides display data for the data drivers 102. Additionally, the timing controller 105 provides the display timing control signals for the data drivers 102, and provides the gate driver timing control signals for the gate drivers 103, to thereby achieve timing control of the liquid crystal display device.

The grayscale generation power supply 104 feeds a set of grayscale voltage generation biases V0 to V8 to the respective data drivers 102. The grayscale voltage generation biases V0 to V8 are used to generate grayscale voltages within the respective data drivers 102, having different voltage levels from one another. Each data drive 102 generates a set of grayscale voltages associated with respective allowed grayscale levels from the grayscale voltage generation biases V0 to V8, and generates data signals through selecting the generated grayscale voltages in response to the display data. The gamma characteristics of the data drivers 102 (that is, the relation between the values of the display data fed to the data drivers 102 and the signal levels of the data signals generated by the data drivers 102) are controlled by the grayscale voltage generation biases V0 to V8.

The structure of the liquid crystal display device shown in FIG. 1, however, is not advantageous from the viewpoint of the cost. One reason is that an increased number of wire lines are necessary for providing electrical connections between the grayscale generation power supply circuit 104 and the data drivers 102, and another reason is that the grayscale generation power supply 104 is prepared separately from the data drivers 102, which undesirably increases the number of the components within the liquid crystal display device.

In order to reduce the cost, as shown in FIG. 2, a structure has been provided in which a grayscale generation power supply circuit is individually integrated in each data driver 102A (See Japanese Laid-Open Patent Application No. 2004-279482). When such structure is used, a set of grayscale voltage generation biases are generated by the grayscale generation power supply circuit 104A within each data driver 102A, and a set of grayscale voltages corresponding to respective allowed grayscale levels are generated from the grayscale voltage generation biases.

The liquid crystal display device 100A shown in FIG. 2A, however, suffers from a drawback so-called "inter-block unevenness". The "inter-block unevenness" is a phenomenon in which the color shading of the display image on the respective regions 106 of the liquid crystal display panel 101 is different depending on the characteristics of the respective data drivers 102A.

According to an inventors' investigation, one of causes of the "inter-block unevenness" is the variations in the offset voltages of the amplifiers integrated within the grayscale generation power supply circuit 104A in the respective data drivers 102A. The offset voltages of the amplifiers integrated within the grayscale generation power supply circuit 104A are inevitably different among the data drivers. The variations in the offset voltages undesirably cause the variations of the gamma characteristics of the data drivers.

Let us consider the case, for example, when the grayscale generation power supply circuit 104A in each data driver 102A is composed of constant voltage sources 201, 202, and a pair of amplifiers 203 and 204, and the grayscale voltages $V_0$ to $V_{63}$ are generated by serially-connected resister 205 connected between the outputs of the amplifiers 203 and 204. In this case, the voltage level of a data signal fed to a specific pixel is selected from the grayscale voltages $V_0$ to $V_{63}$ in response to the display data.

The offset voltages of the amplifiers 203 and 204 within the grayscale generation power supply circuit 104A are placed into selected one of four states "State 1" to "State 4", shown in FIGS. 4A to 4D, respectively. In FIGS. 4A to 4D, the symbols "$V_H$*", "$V_L$*" indicate desired output voltages of the amplifiers 203 and 204, respectively. The "State 1" is a state in which the actual output voltage of the amplifier 203 is higher by the offset A than the desired value $V_H$*, and the actual output voltage of the amplifier 204 is lower by the offset B than the desired value $V_L$*. The "State 2" is a state in which the actual output voltage of the amplifier 203 is lower by the offset A than the desired value $V_H$*, and the actual output voltage of the amplifier 204 is lower by the offset B than the desired value $V_L$*. The "State 3" is a state in which the actual output voltage of the amplifier 203 is higher by the offset A than the desired value $V_H$*, and the actual output voltage of the amplifier 204 is higher by the offset B than the desired value $V_L$*. Finally, the "State 4" is a state in which the actual output voltage of the amplifier 203 is lower by the offset A than the desired value $V_H$*, and the actual output voltage of the amplifier 204 is higher by the offset B than the desired value $V_L$*.

The gamma characteristics of the respective data drivers 102A depend on which states the respective data drivers 102A are placed into. The states of the respective data drivers 102A are randomly determined by the manufacture variations, and this causes the variations in gamma characteristics of the respective data drivers 102A. Such situation also applies to the case when the number of amplifiers integrated within the grayscale generation power supply circuit 104A is increased.

The variations in the offset voltages of the amplifiers within the grayscale generation power supply circuits 104A cause the variations in the gamma characteristics of the respective data drivers 102A. This results in that the voltage levels of the data signals generated by the data drivers for the same display data are different among data drivers. Such variations in the gamma characteristics are recognized by the human eye as the "inter-block unevenness". For example, the boundary between regions driven by adjacent data drivers 102A may be undesirably recognized by the human eye, when the gamma characteristics of the adjacent data drivers 102A are largely different from each other.

As thus described, the liquid crystal display device 100A shown in FIG. 2A suffers from the "inter-block unevenness", resulting from the variations of the offset voltages of the amplifiers within the grayscale generation power supply circuits.

SUMMARY OF THE INVENTION

In an aspect of the present invention, the display device is provided with a display panel including pixels arranged in rows and columns, and a plurality of data drivers connected with the display panel. Each of the data drivers is provided with: a grayscale voltage generation circuit generating a plurality of grayscale voltages; a drive circuitry selecting a selected grayscale voltage from said plurality of grayscale voltages and outputting a data signal having a voltage level corresponding to the selected grayscale voltage to said display panel. The grayscale voltage generation circuit includes an amplifier generating a voltage bias, and a voltage generation circuit generating the plurality of grayscale voltages from the voltage bias. The amplifier is designed so that the polarity of the offset voltage of the amplifier is reversible. The polarity of the offset voltage of the amplifier is controlled so that the polarity of the offset voltage set in driving a specific one of the pixels in a first frame period is opposite to the polarity of the offset voltage set in driving the specific pixel in a second frame period.

In the display device thus designed, the polarity of the offset voltage of the amplifier is reversed between the first and second frame periods to thereby virtually cancel the error of the voltage level of the data signal fed to the pixel from the desired value in terms of the time average. This effectively reduces the "inter-block unevenness" caused by the variations of the offset voltages of the amplifier that generates the voltage bias.

BRIEF DESCRIPTION OF THE DRAWINGS

The above and other advantages and features of the present invention will be more apparent from the following description taken in conjunction with the accompanied drawings, in which.

DESCRIPTION OF THE PREFERRED EMBODIMENTS

Figure 1:
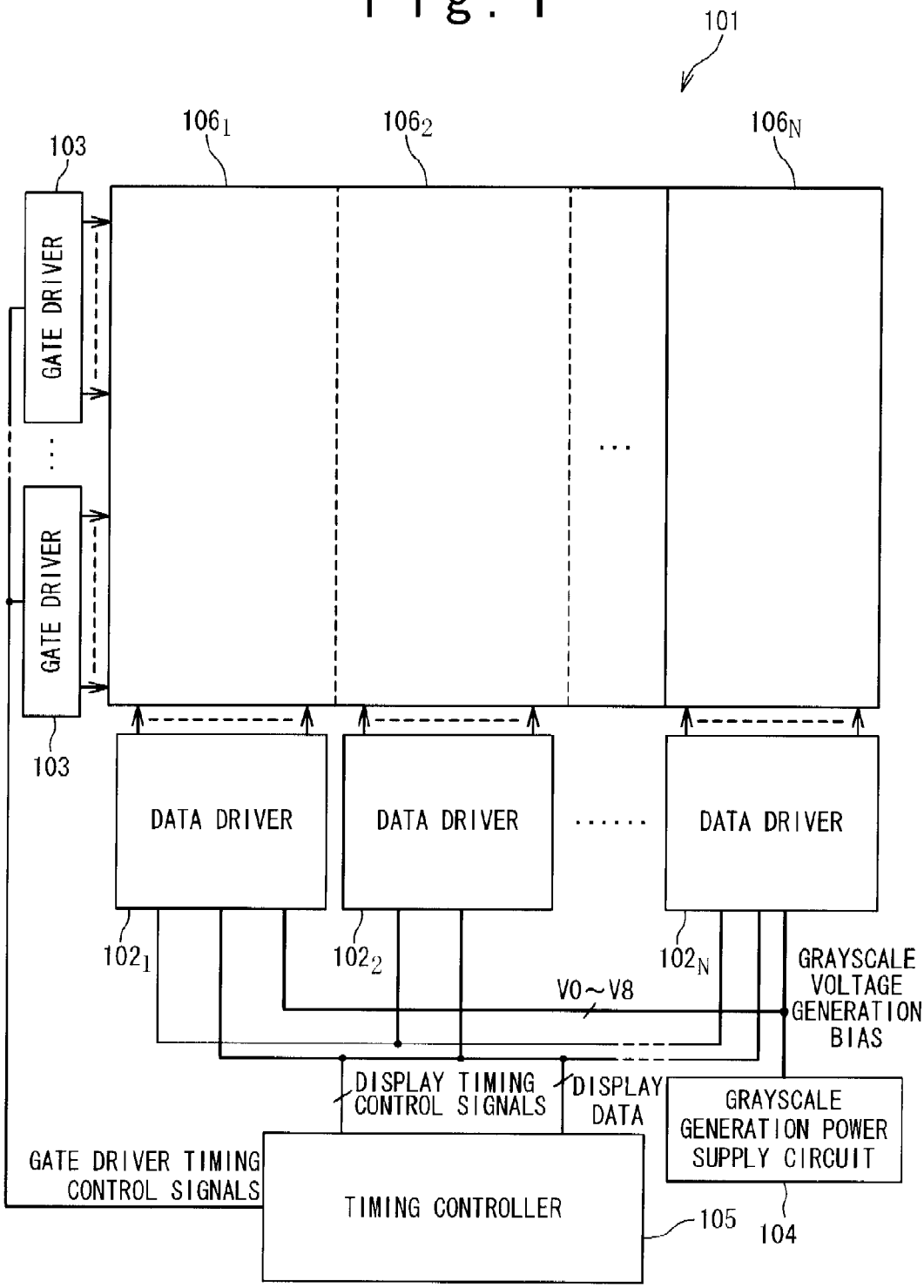
FIG. 1 is a block diagram illustrating a typical structure of a conventional liquid crystal display device.
Figure 2:
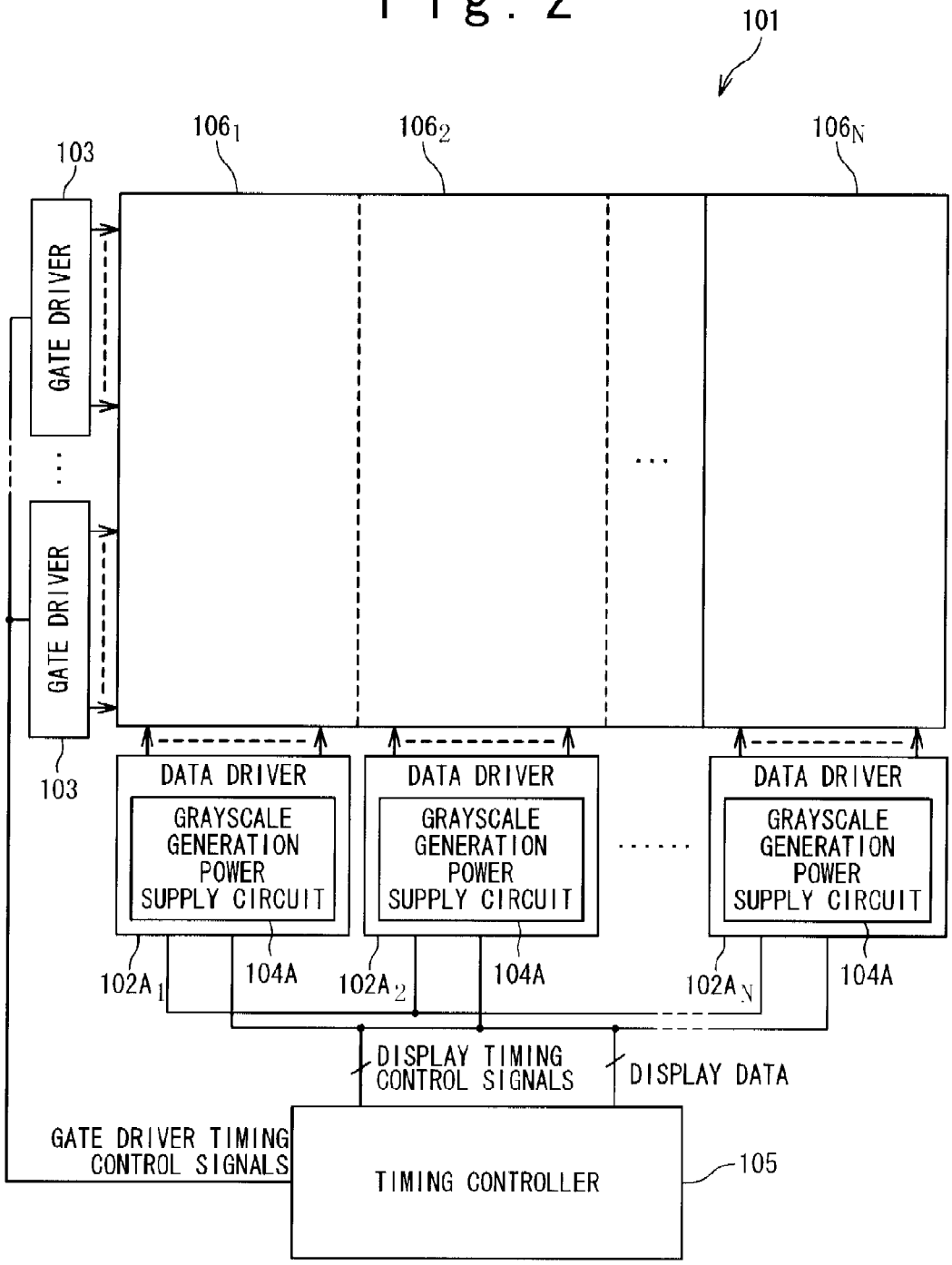
FIG. 2 is a block diagram illustrating another typical structure of a conventional liquid crystal display device.
Figure 3:
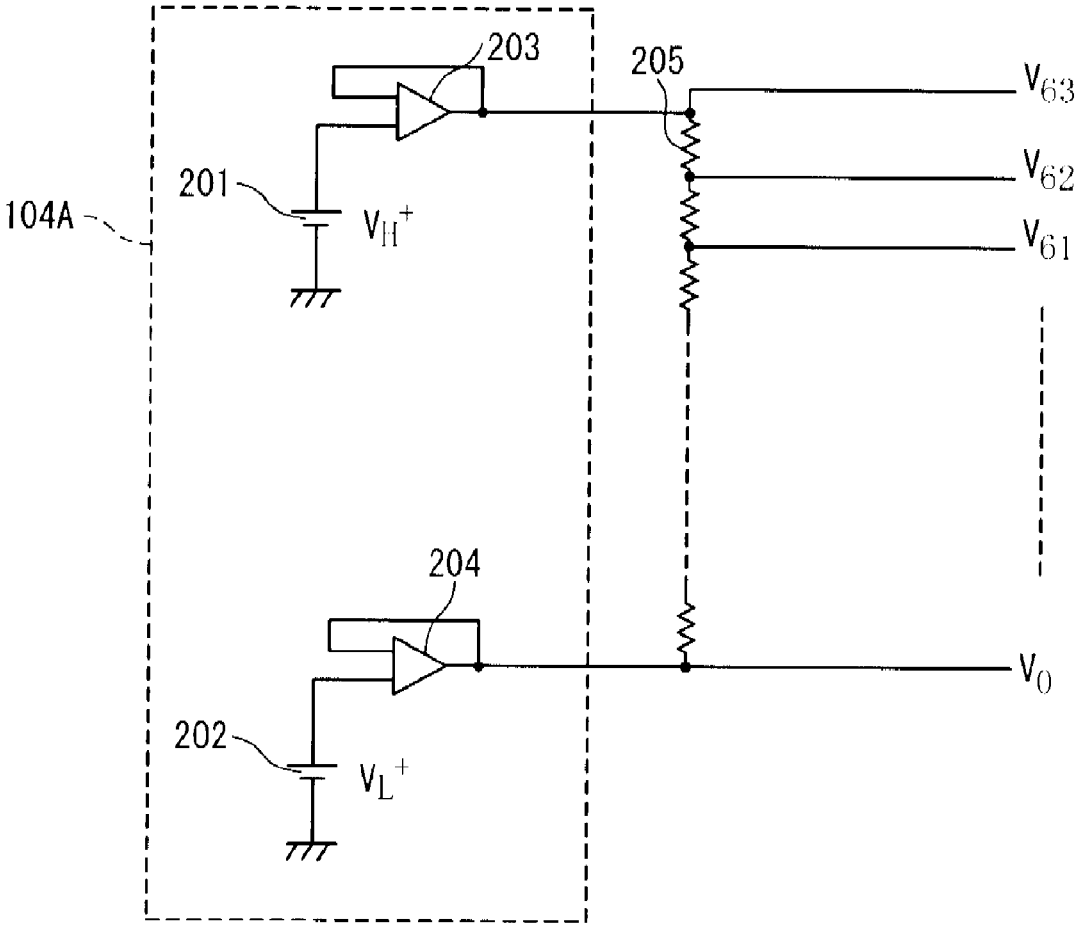
FIG. 3 is a circuit diagram illustrating an example of the configuration of the grayscale voltage generator circuit.
Figure 4A:
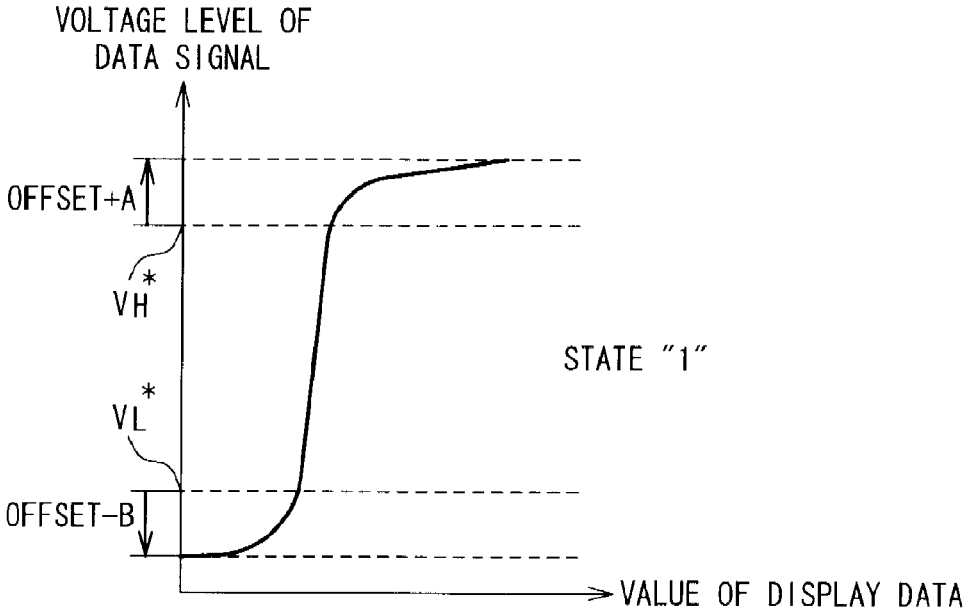
FIGS. 4A to 4D illustrate graphs explaining the effect of offset voltages of amplifiers within the conventional grayscale voltage generator circuit.
Figure 4B:
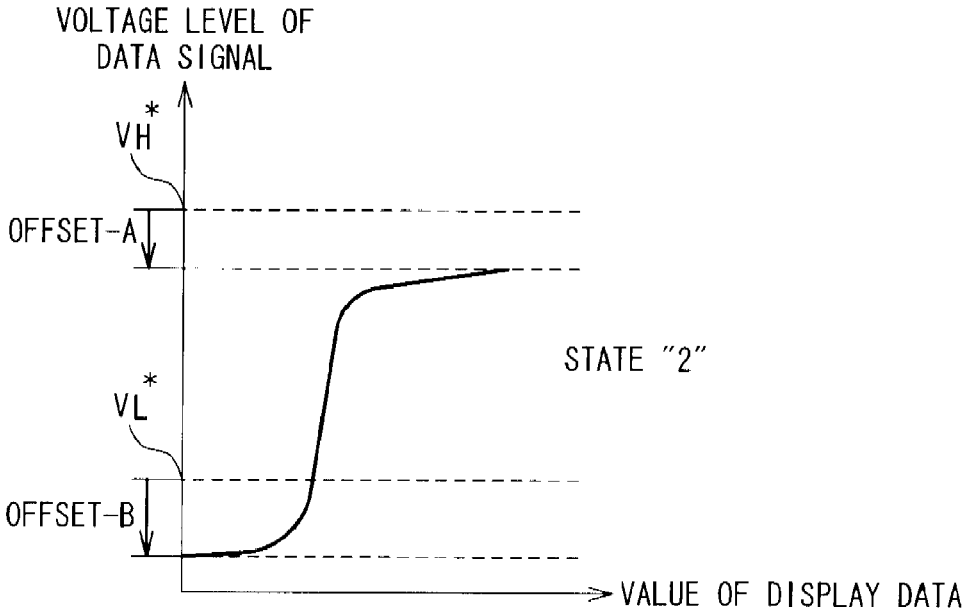
Figure 4C:
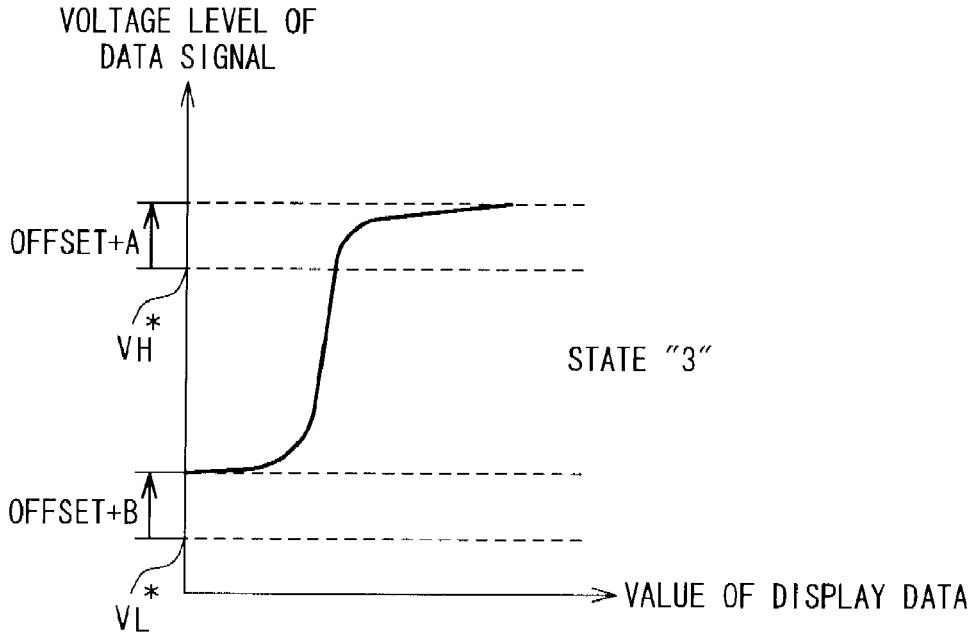
Figure 4D:
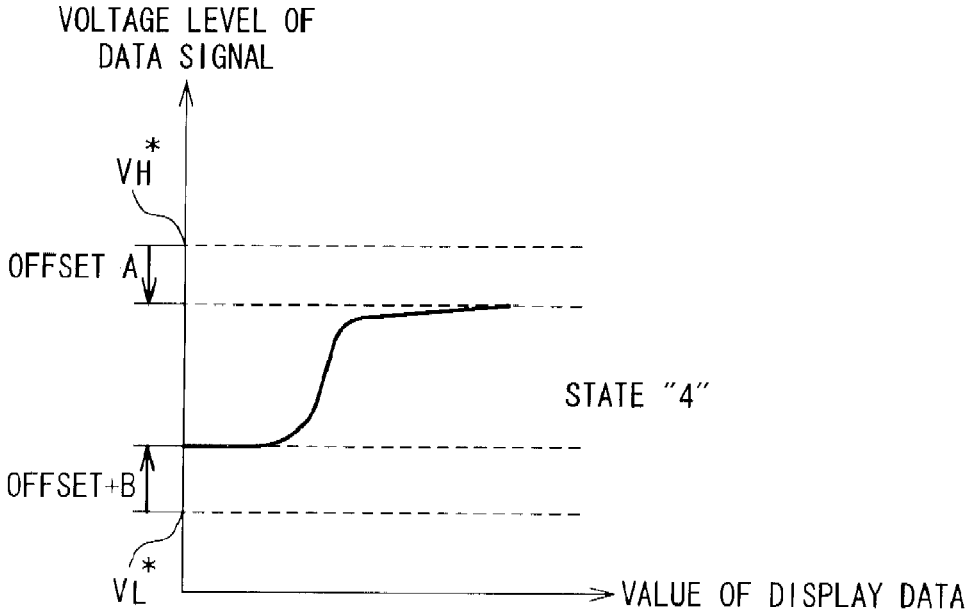

The invention will be now described herein with reference to illustrative embodiments. Those skilled in the art would recognize that many alternative embodiments can be accomplished using the teachings of the present invention and that the invention is not limited to the embodiments illustrated for explanatory purposed. It should be noted that the same or corresponding elements are denoted by the same or similar reference numerals. Suffixes are used to distinguish the elements denoted by the same reference numeral, and the suffixes may be omitted when the elements denoted by the same reference numeral need not to be distinguished.

First Embodiment

Figure 5:
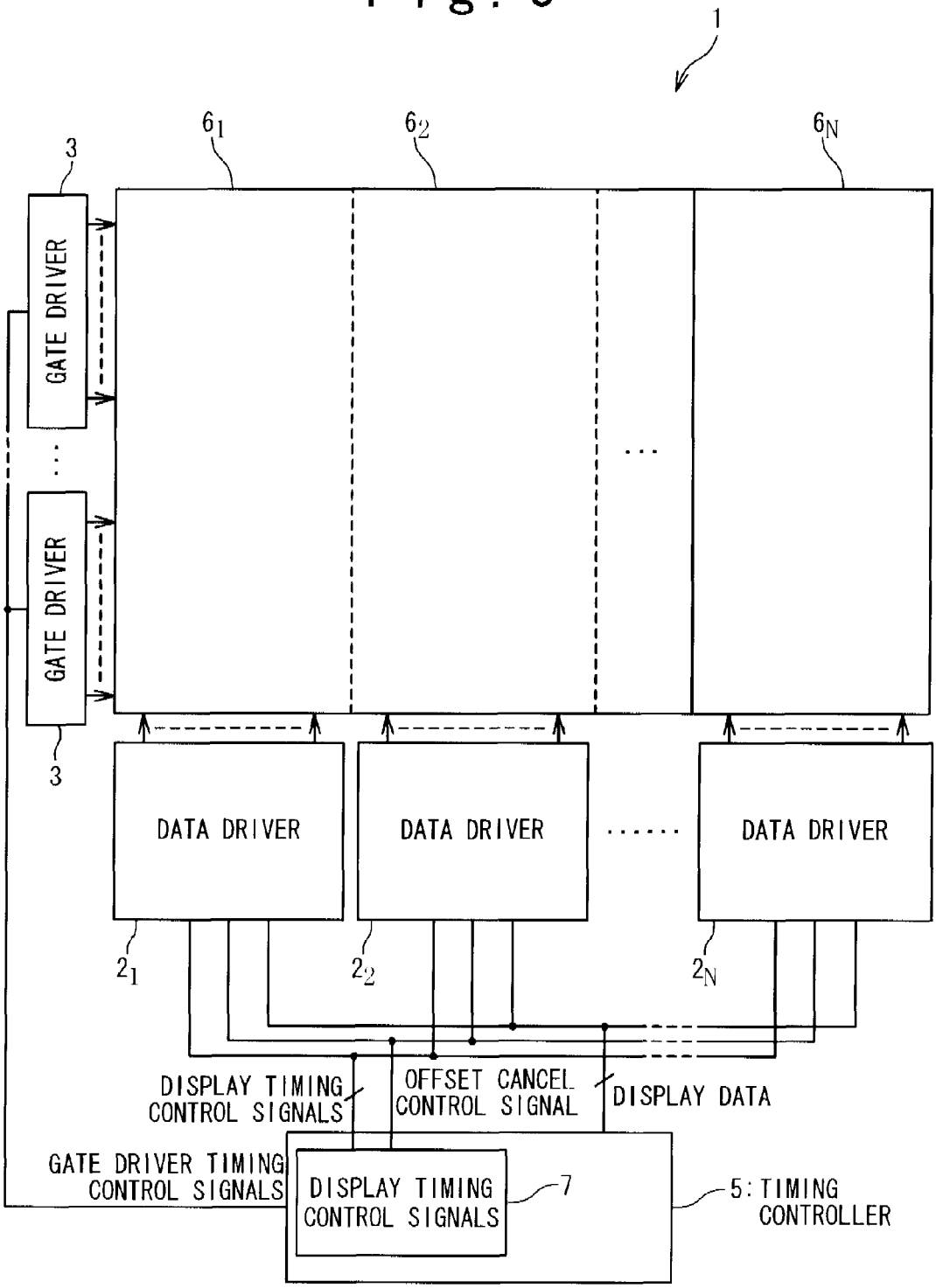
FIG. 5 is a block diagram illustrating the structure of a display device in a first embodiment of the present invention.

FIG. 5 is a block diagram illustrating a structure of a display device in a first embodiment of the present invention.

The display device shown in FIG. 5 is provided with a liquid crystal display panel 1, a plurality of data drivers $\mathbf{2}_1$ to $\mathbf{2}_N$, a plurality of gate drivers 3, a timing controller 5. The liquid crystal display panel 1 is divided into a plurality of regions $\mathbf{6}_1$ to $\mathbf{6}_N$, and each region $\mathbf{6}_i$ is connected with the associated data driver $\mathbf{2}_i$.

The liquid crystal display panel 1 is provided with a set of scan lines extending in the horizontal direction, a set of signal lines extending in the vertical direction, and pixels arranged at respective intersections of the scan lines and the signal lines. It should be noted that the scan lines, the signal lines, and the pixels are not shown in FIG. 5. The rows of the pixels arrayed in the horizontal direction may be referred to as line, hereinafter. The pixels in the same line is connected with the same scan line, and driven in the same horizontal period.

The data driver $\mathbf{2}_i$ generates data signals having voltage levels corresponding to display data received from the timing controller 5 to thereby drive signal lines (data lines) within the associated region $\mathbf{6}_i$ of the liquid crystal display panel 1. In this embodiment, the display data are 6-bit data. The operation timing of the data driver 2 is controlled by display timing control signals (including a polarity signal, a latch signal, and a shift pulse).

The gate drivers 3 drive scan lines (gate lines) of the liquid crystal display panel 1 in response to gate driver timing control signals (including a vertical sync signal). The data signals generated by the data drivers 2 are fed to the pixels connected with a scan line selected by the gate drivers 3 to thereby drive the respective pixels within the liquid crystal display panel 1.

The timing controller 5 provides the data drivers 2 with the display data. Additionally, the timing controller 5 incorporates a display timing generator circuit 7, and achieves timing control of the liquid crystal display device by using the display timing generator circuit 7. The display timing generator circuit 7 feeds the display timing control signals to the data drivers 2, and also feeds the gate driver timing control signals to the gate drivers 3.

Additionally, the display timing generator circuit 7 is designed to generate an offset cancel control signal, and to feed the offset cancel control signal to the data drivers 2. The offset cancel control signal is used to control offset voltages of amplifies in a grayscale generation power supply circuit integrated within each data driver 2. Details of the offset cancel control signal are described later.

Figure 6:
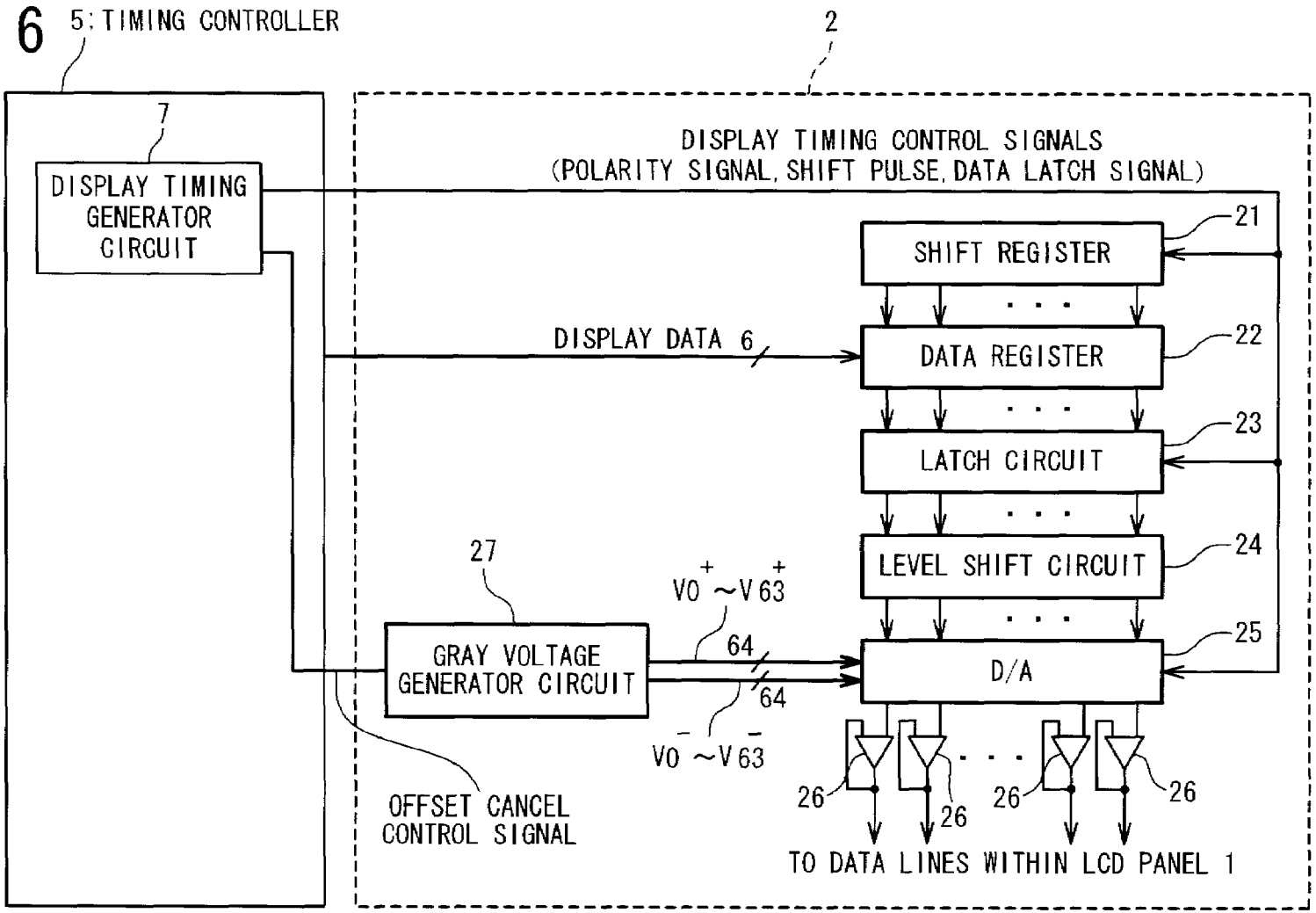
FIG. 6 is a block diagram illustrating the configuration of a data driver of the display device in the first embodiment.

FIG. 6 is a block diagram illustrating the configuration of the data drivers 2. The data drivers 2 are each provided with a shift register 21, a data register 22, a latch circuit 23, a level shifter circuit 24, a D/A converter 25, a set of output amplifiers 26, a grayscale voltage generator circuit 27, and a timing generator circuit 28.

The shift register 21 is used to generate a set of control signals for controlling the timings at which respective registers within the data register circuit 22 latches the associated display data. The shift register 21 has the serial-input and parallel-output configuration, and performs a data shift operation therein in response to the shift pulse received from the display timing generator circuit 7. The data shift operation results in that the control signals fed to the data register circuit 22 are sequentially activated to thereby sequentially operate the respective registers within the data register circuit 22.

The data register circuit 22 is designed to sequentially receive the display data from the timing controller 5. The data register circuit 22 incorporates a set of registers (now shown), the number of which is identical to that of the data lines to be driven by the data driver 2, and each register is configured to store display data for one pixel. Such structure allows the data register circuit 22 to store display data of pixels belonging to one line. The respective registers within the data register circuit 22 receives the control signals from the shift register 21, and latches the display data in response to the associated control signals.

The latch circuit 23 is responsive to the latch circuit received from the display timing generator circuit 7 for latching the display data of pixels belonging to one line from the data register circuit 22. The display data latched is transferred to the D/A converter 25 through the level shifter circuit 24.

The level shifter circuit 24 provides signal level matching between the output of the latch circuit 23 and the input of the D/A converter 25.

The D/A converter 25 provides D/A conversion for the display data received from the latch circuit 23. A set of grayscale voltages $V_0^+$ to $V_{63}^+$, and $V_0^-$ to $V_{63}^-$ received from the grayscale voltage generator circuit 27 are used to the D/A conversion by the D/A converter 25. The grayscale voltages $V_0^+$ to $V_{63}^+$ have the "positive" polarity with respect to the common level (that is, the voltage level on the back electrode of the liquid crystal display panel 1), and the grayscale voltages $V_0^-$ to $V_{63}^-$ have the "negative" polarity with respect to the common level, while the following formula holds:

$$V_{63}^- < V_{62}^- < \ldots < V_0^- < V_{COM} < V_0^+ < V_1^+ < \ldots < V_{63}^+,$$

where $V_{COM}$ is the common level. In this specification, the polarities of the grayscale voltages and the data signals are defined with respect to the common level (that is, the voltage level on the back electrode of the liquid crystal display panel 1).

When a specific pixel is driven with a "positive" data signal, the D/A converter 25 selects a grayscale voltage corresponding to the display data of the specific pixel, and outputs the selected grayscale voltage to the associated output amplifier 26. In detail, when the display data of the specific pixel is "k", which is an integer from 0 to 63, and the specific pixel is driven with a positive data signal, the grayscale voltage $V_k^+$ is selected and outputted to the associated output amplifier 26. Correspondingly, when the display data of the specific pixel is "k" and the specific pixel is driven with a negative data signal, the grayscale voltage $V_k^-$ is selected and outputted to the associated output amplifier 26.

The polarities of the grayscale voltages outputted from the D/A converter 25, which are associated with the respective pixels, are controlled on the polarity signal received from the display timing generator circuit 7 to achieve inversion drive. In response to the polarity signal, the polarities of the data signals fed to the respective pixels are inverted every frame period (that is, at a cycle of two frame periods).

The output amplifiers 26 generate data signals in response to the grayscale voltages received from the D/A converter 25 to drive the associated signal lines within the liquid crystal display panel 1. The output amplifiers 26 are each composed of a voltage follower, and the voltage levels of the data signals are substantially identical to the grayscale voltages received from the D/A converter 25.

The grayscale voltage generator circuit 27 feeds the grayscale voltages $V_0^+$-$V_{63}^+$ and $V_0^+$-$V_{63}^+$ to the D/A converter 25. The grayscale voltage generator circuit 27 receives the offset cancel control signal from the display timing display circuit 7. The offset cancel control signal is used to control the offset voltages of the amplifiers integrated within the grayscale voltage generator circuit 27. As described later in detail, it is of significance in the display device of this embodiment that the offset voltages of the amplifiers integrated within the grayscale voltage generator circuit 27 are controllable.

Figure 7:
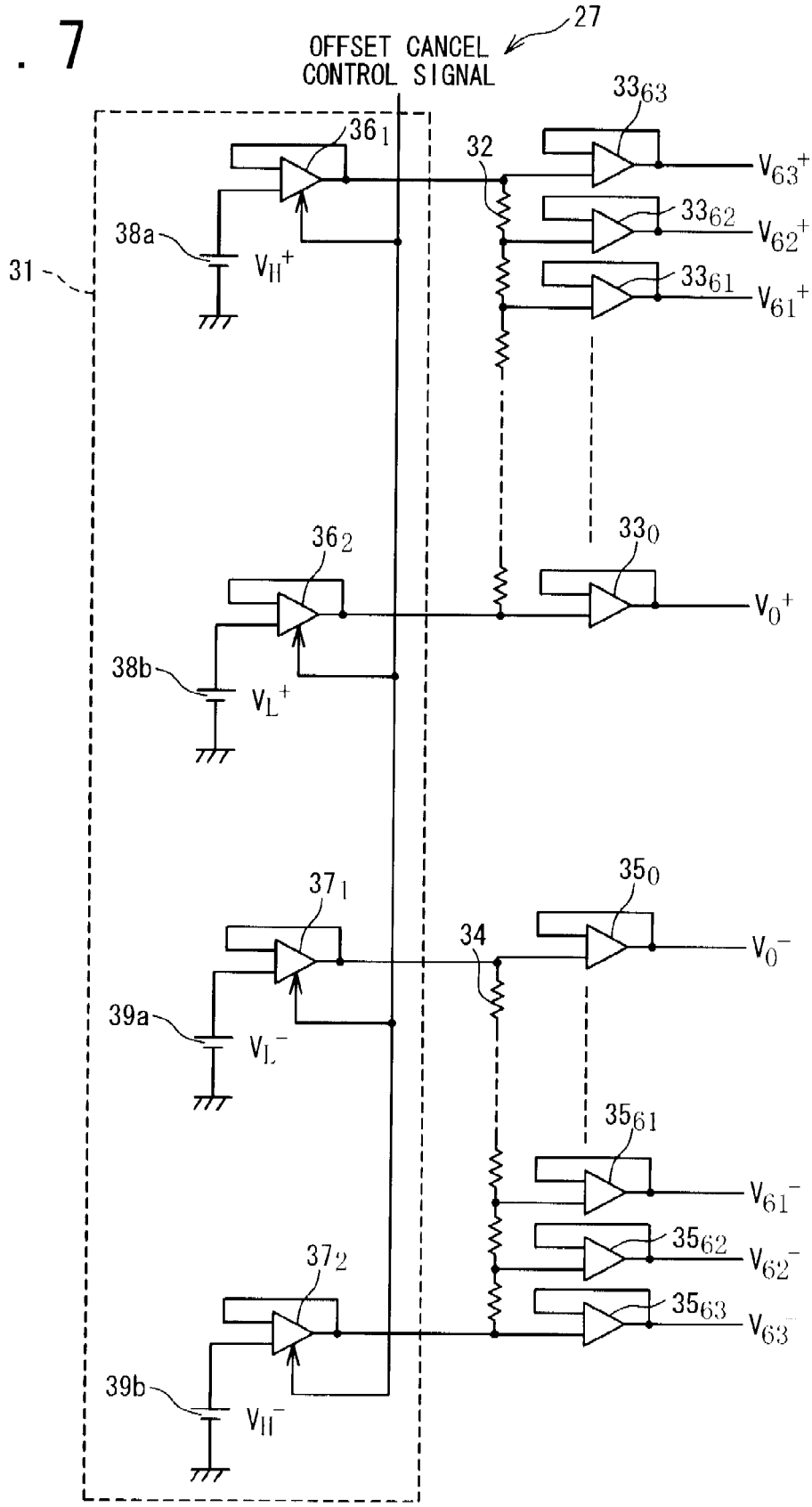
FIG. 7 is a circuit diagram illustrating a configuration of a grayscale voltage generator circuit integrated within the data driver shown in FIG. 6.

FIG. 7 is a circuit diagram illustrating the configuration of the grayscale voltage generator circuit 27. The grayscale voltage generator circuit 27 is provided with a grayscale generation power supply circuit 31, serially-connected resistors 32, 34, amplifiers $\mathbf{33}_0$-$\mathbf{33}_{63}$, and $\mathbf{35}_0$-$\mathbf{35}_{63}$. The grayscale generation power supply circuit 31 generates the voltage biases used to generate the grayscale voltages $V_0^+$-$V_{63}^+$ and $V_0^+$-$V_{63}^+$. In this embodiment, the grayscale generation power supply circuit 31 generates four voltage biases $V_H^+$, $V_L^+$, $V_L$, and $V_H$. The polarity of the voltage biases $V_H^+$ and $V_L^+$ is positive, while the polarity of the voltage biases $V_L$ and $V_H^-$ is negative. The voltage levels of the voltage biases $V_H^+$, $V_L^+$, $V_L$, and $V_H^-$ satisfies the following relation:

$$V_H^+>V_L^+>V_{COM}>V_L^->V_H^-,$$

where $V_{COM}$ is the common level. The voltage bias $V_H^+$ is fed to one end of the serially-connected resistors 32 and the voltage bias $V_L^+$ is fed to the other end of the serially-connected resistors 32. On the other hand, the voltage bias $V_L^-$ is fed to one end of the serially-connected resistors 34 and the voltage bias $V_H^-$ is fed to the other end of the serially-connected resistors 34.

The serially-connected resistors 32 and the amplifiers $\mathbf{33}_0$-$\mathbf{33}_{63}$ function as a circuitry generating the grayscale voltages $V_0^+$-$V_{63}^+$ from the voltage biases $V_H^+$ and $V_L^+$. The amplifiers $\mathbf{33}_0$-$\mathbf{33}_{63}$ generate the grayscale voltages $V_0^+$-$V_{63}^+$ from the voltages developed across the serially-connected resistors 32. Specifically, the inputs of the amplifiers $\mathbf{33}_0$-$\mathbf{33}_{63}$ are connected with taps prepared over the serially-connected resistors 32, and the amplifiers $\mathbf{33}_0$-$\mathbf{33}_{63}$ are each designed to operate as a voltage follower. As a result, the grayscale voltages $V_0^+$-$V_{63}^+$ are outputted from the outputs of amplifiers $\mathbf{33}_0$-$\mathbf{33}_{63}$, respectively. The grayscale voltages $V_0^+$-$V_{63}^+$ respectively have voltage levels corresponding to the voltage levels on the taps at which the amplifiers $\mathbf{33}_0$-$\mathbf{33}_{63}$ are connected with the serially-connected resistors 32.

Correspondingly, the serially-connected resistors 34 and the amplifiers $\mathbf{35}_0$-$\mathbf{35}_{63}$ function as a circuitry generating the grayscale voltages $V_0^-$-$V_{63}^-$ from the voltage biases $V_H^-$ and $V_L^-$. The amplifiers $\mathbf{33}_0$-$\mathbf{33}_{63}$ each operate as a voltage follower, and generate the grayscale voltages $V_0^-$-$V_{63}^-$ from the voltages developed across the serially-connected resistors 34. The grayscale voltages $V_0^-$-$V_{63}^-$ respectively have voltage levels corresponding to the voltage levels on the taps at which the amplifiers $\mathbf{35}_0$-$\mathbf{35}_{63}$ are connected with the serially-connected resistors 34.

The grayscale generation power supply circuit 31 is provided with amplifiers $\mathbf{36}_1$, $\mathbf{36}_2$, $\mathbf{37}_1$, $\mathbf{37}_2$ and constant voltage sources 38*a*, 38*b*, 39*a*, and 39*b*. The constant voltage sources 38*a*, 38*b*, 39*a*, and 39*b* generates voltages of the same levels as the voltage biases $V_H^+$, $V_L^+$, $V_L^-$ and $V_H^-$, respectively. The amplifiers $\mathbf{36}_1$, $\mathbf{36}_2$, $\mathbf{37}_1$, $\mathbf{37}_2$ operate as voltage followers and generate the voltage biases $V_H^+$, $V_L^+$, $V_L^-$ and $V_H^-$ from the voltages received from the constant voltage sources 38*a*, 38*b*, 39*a* and 39*b*, respectively.

The amplifiers 36 and 37 are each configured to allow the polarity of the offset voltage thereof to be reversible. In general, a voltage follower composed of a two-input amplifier inevitably suffers from an offset of a certain polarity, due to the difference of characteristics of paired differential transistors, for example. In detail, when a certain input voltage is inputted to one input of a two-input amplifier having the output connected with the other input, the output voltage of the two-input amplifier is ideally identical to the input voltage; however, the output voltage may be different from the input voltage with a positive or negative offset, due to the characteristics of the two-input amplifier. In this embodiment, the polarities of the offset voltages of the amplifiers 36 and 37 are switched in response to the offset cancel control signal.

Figure 8A:
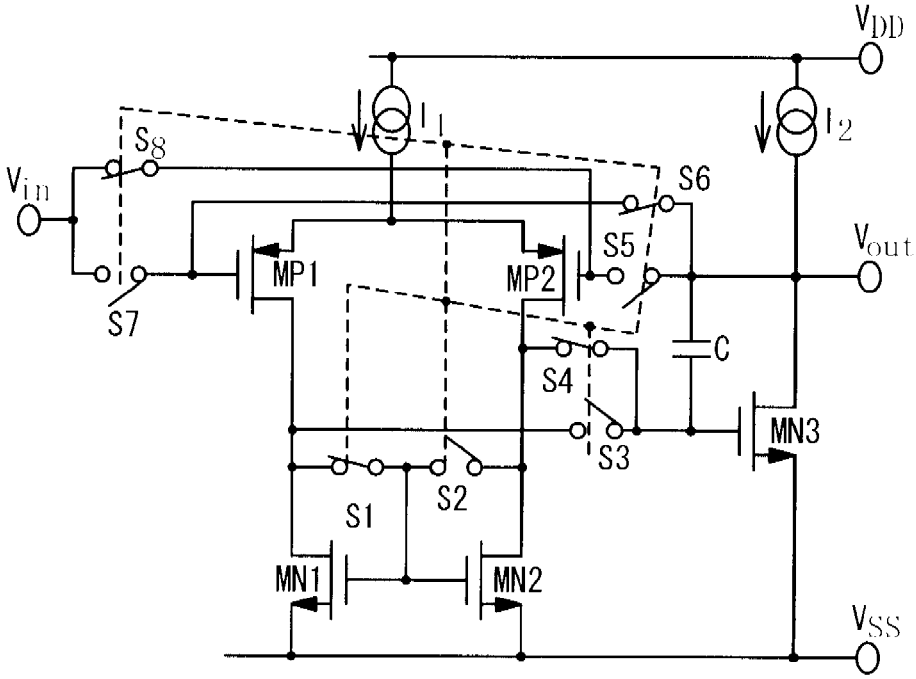
FIGS. 8A and 8B are circuit diagram illustrating the configuration of amplifiers generating grayscale voltage generation biases.

FIG. 8A is a circuit diagram illustrating an exemplary configuration of the amplifiers 36 and 37. The amplifiers 36 and 37 are each composed of PMOS transistors MP1, MP2, NMOS transistors MN1 to MN3, switch elements S1 to S8, constant current sources $I_1$, $I_2$, and a capacitor C.

The PMOS transistors MP1 and MP2 operate as a transistor pair within the input stage of the amplifiers 36 and 37. The sources of the PMOS transistors MP1 and MP2 are connected with the output of the constant voltage source $I_1$. The input of the constant voltage source $I_1$ is connected with a power line having a voltage level $V_{DD}$ (that is, the power supply level). The drains of the PMOS transistors MP1 and MP2 are connected with the drains of the NMOS transistors MN1 and MN2, respectively.

The gates of the NMOS transistors MN1 and MN2 are commonly connected, and therefore the NMOS transistors MN1 and MN2 operate as a current mirror. The sources of the NMOS transistors MN1 and MN2 are commonly connected with a power line having a voltage level $V_{SS}$ (that is, the ground level).

The input and output of the current mirror comprised of NMOS transistors MN1 and MN2 are switchable by the switch elements S1 to S4. The drains of the NMOS transistors MN1 and MN2 are connected with the commonly connected gates of the NMOS transistors MN1 and MN2 through the switch elements S1 and S2, respectively. The drains of the NMOS transistors MN1 and MN2 are further connected with the gate of the NMOS transistor MN3 through the switch elements S3 and S4, respectively. When the switch elements S1 and S4 are turned on with the switch elements S2 and S3 turned off, the drain of the NMOS transistor MN1 is used as the input of the current mirror, and the drain of the NMOS transistor MN2 is used as the output of the current mirror. When the switch elements S2 and S3 are turned on with the switch elements S1 and S4 turned off, on the other hand, the drain of the NMOS transistor MN2 is used as the input of the current mirror, and the drain of the NMOS transistor MN1 is used as the output of the current mirror.

The NMOS transistor MN3 has a source connected with a power line having the voltage level $V_{SS}$, and a drain connected with the output terminal Vout and the output of the constant current source $I_2$. The input of the constant current source $I_2$ is connected with a power line having the voltage level $V_{DD}$. The output terminal Vout is connected with the gate of the NMOS transistor MN3 through the capacitor C.

The switch elements S5 to S8 are used to switch connections among the input terminal Vin, the output terminal Vout and the gates of the PMOS transistors MP1 and MP2. The switch element S5 is connected between the output terminal and the gate of the PMOS transistor MP2, and the switch element S6 is connected between the output terminal Vout and the gate of the PMOS transistor MP1. On the other hand, the switch element S7 is connected between the input terminal Vin and the gate of the PMOS transistor MP1, and the switch element S8 is connected between the input terminal Vin and the gate of the PMOS transistor MP2.

When the amplifiers 36 and 37 are structured as shown in FIG. 8A, the polarities and magnitudes of the offset voltages of the amplifiers 36 and 37 are dependent on the difference of the characteristics of the PMOS transistors MP1 and MP2, and the difference of the NMOS transistors MN1 and MN2. The polarities of the offset voltages of the amplifiers 36 and 37 are reversible by turn-on and -off of the switch elements S1 to S8.

When the offset voltage of the amplifier 36 or 37 is desired to be set to a certain polarity, as shown in FIG. 8A, the switch elements S6 and S8 are turned on and the switch elements S5 and S7 are turned off. As a result, the input terminal Vin is electrically connected with the PMOS transistor MP2 and the output terminal Vout is electrically connected with the PMOS transistor MP1. Additionally, the switch elements S1 and S4 are turned on and the switch elements S2 and S3 are turned off. This results in that the drain of the NMOS transistor MN1 functions as the input of the current mirror, while the drain of the NMOS transistor MN2 functions as the output of the current mirror.

Figure 8B:
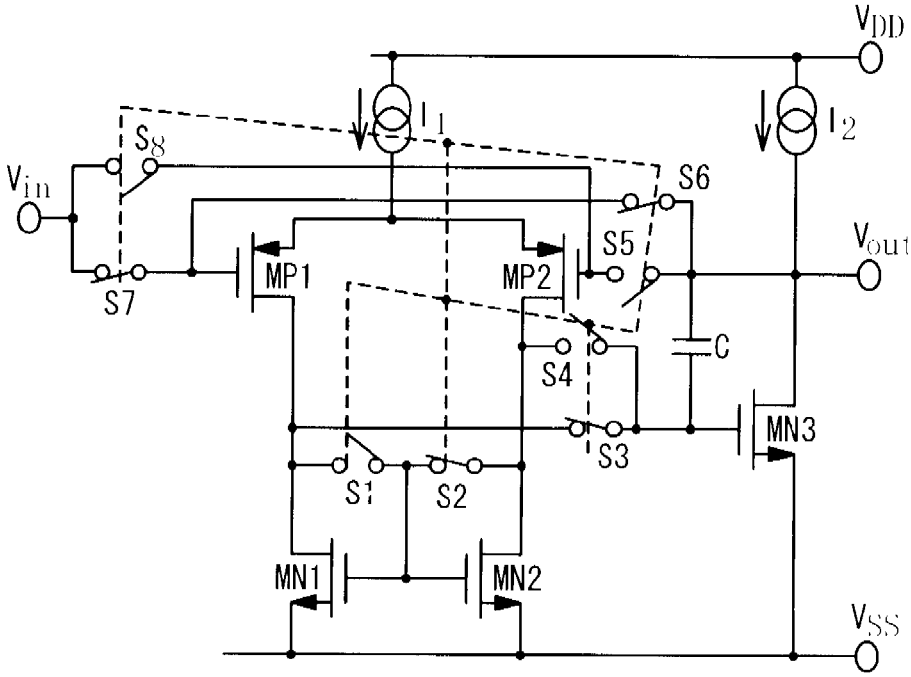

When the offset voltage of the amplifier 36 or 37 is desired to be set to the opposite polarity, on the other hand, the switch elements S5 and S7 are turned on, and the switch elements S6 and S8 are turned off, as shown in FIG. 8B. As a result, the input terminal Vin is electrically connected with the PMOS transistor MP1, and the output terminal Vout is electrically connected with the PMOS transistor MP2. Additionally, the switch elements S2 and S3 are turned on and the switch elements S1 and S4 are turned off. This results in that the drain of the NMOS transistor MN2 functions as the input of the current mirror, while the drain of the NMOS transistor MN1 functions as the output of the current mirror.

The above-described operation allows the amplifiers 36 and 37 to switch the polarities of the offset voltages thereof. It should be noted, with emphasis, that the configuration of the amplifiers 36 and 37 is not limited to that illustrated in FIG. 8A, and other configurations that allow the polarities of the offset voltages to be reversible may be applied to the amplifiers 36 and 37.

Figure 9A:
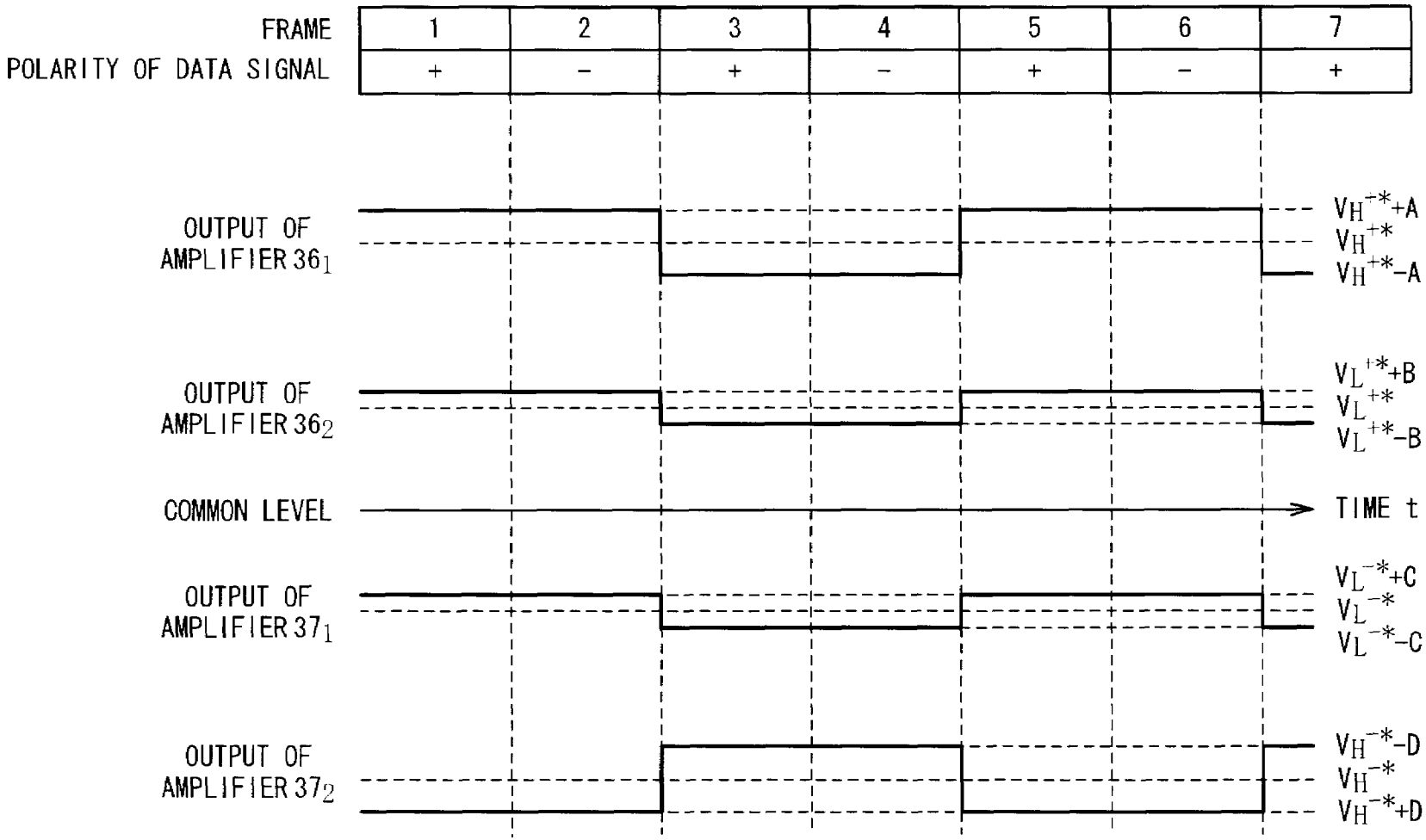
FIG. 9A is a timing chart illustrating a preferred control method of the polarities of the offset voltages of the amplifiers and the polarities of data signals.

One feature of the display device of this embodiment exists in that the polarities of the offset voltages of the amplifiers 36 and 37 within the grayscale generation power supply circuit 31 are switched at a certain cycle in the data drivers 2. In this embodiment, as shown in FIG. 9A, the polarities of the offset voltages of the amplifiers 36 and 37 are switched every two frame periods (that is, at a cycle of four frame periods). In other words, the amplifiers 36 and 37 are each operated so that the offset voltage thereof has a specific polarity in certain two frame periods, while the offset voltage have the opposite polarity in the following two frame periods.

Such operation allows canceling the effect of the offset voltages of the amplifiers 36 and 37 within the grayscale generation power supply circuit 31 for the respective pixels of the liquid crystal display panel 1, and thereby absorbs the difference of the gamma characteristics among the data drivers 2 in terms of the time average. This effectively reduces the "inter-block unevenness" due to the variations in the offset voltages of the amplifiers 36 and 37.

It should be noted that the cycle at which the polarities of the data signals are switched is two frame periods, shorter than the cycle at which the polarities of the offset voltages of the amplifiers 36 and 37 are switched. This aims to reduce the direct current component of the drive voltage applied to each pixel, and to exhibit all the possible combinations of the polarities of the data signals and offset voltages of the amplifiers 36 and 37. With respect to one specific pixel, there are two allowed states for the data signal, and two allowed states for the offset voltages of the amplifiers 36 and 37. This implies that there are four allowed states for each data driver 2. In order to cancel the effect of the offset voltages of the amplifiers 36 and 36, it is advantageous that each data driver 4 periodically exhibits these four states. In the meantime, it is desirable for reducing the direct current component of the drive voltage applied to each pixel that the polarities of the data signals are inverted at the shortest cycle. Therefore, the polarities of the data signals are inverted at a cycle of two frame periods, while the polarities of the offset voltages of the amplifiers 36 and 37 are inverted at a cycle of four frame periods.

For example, a specific pixel is driven with a positive data signal in a first frame period in a state in which the offset voltages of the amplifiers $\mathbf{36}_1$, $\mathbf{36}_2$, $\mathbf{37}_1$, and $\mathbf{37}_2$ are set to "+A", "+B", "+C", "+D", respectively. In FIG. 9, "$V_H^+$*", "$V_L^+$*", "$V_L^-$*", and "$V_H^-$*" are desired values of the voltage biases generated by the amplifiers $\mathbf{36}_1$, $\mathbf{36}_2$, $\mathbf{37}_1$, and $\mathbf{37}_2$. It should be noted that the positive signs attached with the offset voltages "A", "B", "C" and "D" only indicate that the polarities of the offset voltages are set to one of the two possible polarities; the offset voltages of the amplifiers $\mathbf{36}_1$, $\mathbf{36}_2$, $\mathbf{37}_1$, and $\mathbf{37}_2$ may be negative. FIG. 9 shows a case in which the offset voltages of the amplifiers $\mathbf{36}_1$, $\mathbf{36}_2$ and $\mathbf{37}_1$ are positive and the offset voltage of the amplifier $\mathbf{37}_2$ is negative.

In a second frame period following the first frame period, the specific pixel is driven with a negative data signal in a state in which the polarities of the offset voltages of the amplifiers $\mathbf{36}_1$, $\mathbf{36}_2$, $\mathbf{37}_1$, and $\mathbf{37}_2$ are identical to those in the first frame period. In a third frame period following the second frame period, the specific pixel is driven with a positive data signal in a state in which the polarities of the offset voltages of the amplifiers $\mathbf{36}_1$, $\mathbf{36}_2$, $\mathbf{37}_1$, and $\mathbf{37}_2$ are opposite to those in the first frame period; in other words, the offset voltages of the amplifiers $\mathbf{36}_1$, $\mathbf{36}_2$, $\mathbf{37}_1$, and $\mathbf{37}_2$ are set to "−A", "−B", "−C" and "−D". In a fourth frame period following the third frame period, the specific pixel is driven with a negative data signal in a state in which the polarities of the offset voltages of the amplifiers $\mathbf{36}_2$, $\mathbf{36}_2$, $\mathbf{37}_2$, and $\mathbf{37}_2$ are identical to those in the third frame period. In the following frames, the operations in the first to fourth frame periods are repeated.

In the following, a description is given of the fact that such operation effectively reduces the "inter-block unevenness" with an example in which an image is displayed so that all the pixels are set to the same grayscale level for a sufficiently long time period. It should be noted that an image suffers from the inter-block unevenness" most severely when all the pixels are set to the same grayscale level.

Figure 10A:
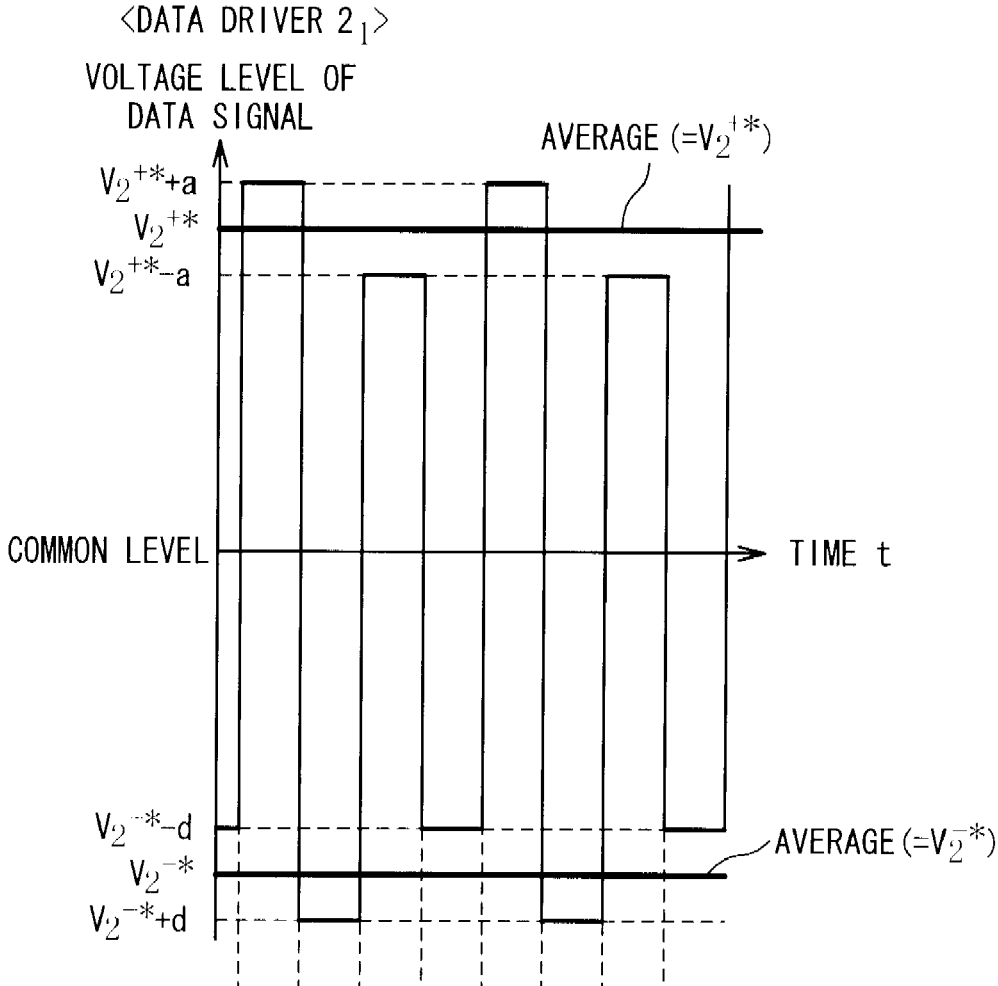
FIG. 10A is a graph illustrating a voltage level of a data signal outputted from a certain data driver.
Figure 10B:
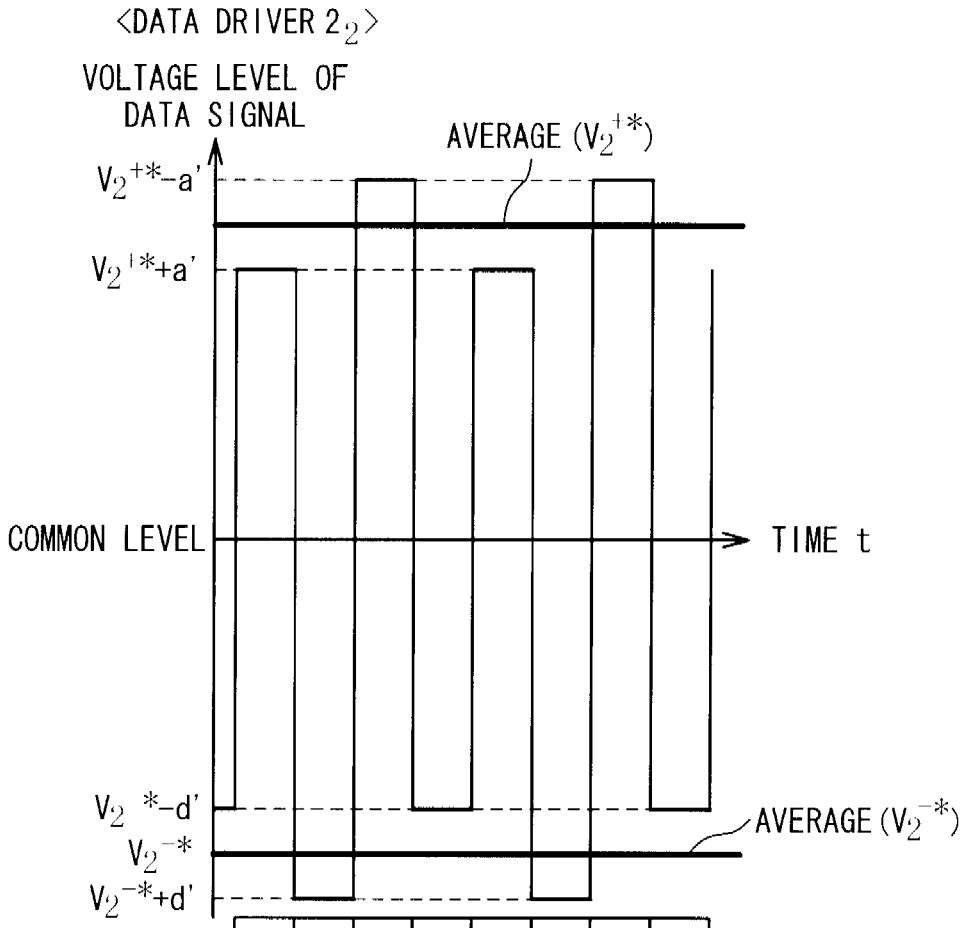
FIG. 10B is a graph illustrating a voltage level of a data signal outputted from another data driver.

FIG. 10A illustrates voltage levels of data signals sequentially developed by the data driver $\mathbf{2}_1$, and FIG. 10B illustrates voltage levels of data signals sequentially developed by the data driver $\mathbf{2}_2$. It should be noted that the values of the associated display data are set to "2" in the operations shown in FIGS. 10A and 10B. In the following, the desired value of the grayscale voltage $V_2^+$, which corresponds to the display data of "2", is referred to as "$V_2^+$*", and the desired value of the grayscale voltage $V_2^-$ is referred to as "$V_2^-$*". In the operations shown in FIGS. 10A and 10B, the data drivers $\mathbf{2}_1$ and $\mathbf{2}_2$ are desired to output data signals having voltage levels identical to the grayscale voltages $V_2^+$ and $V_2^-$, respectively; however, the data drivers $\mathbf{2}_1$ and $\mathbf{2}_2$ does not actually generate such data signals due to the offset voltages thereof.

Let us assume that the offset voltages of the amplifiers $\mathbf{36}_1$ and $\mathbf{36}_2$ within the data driver $\mathbf{2}_1$ are set to "+A" and "+B", respectively, and the offset voltages of the amplifiers $\mathbf{36}_1$ and $\mathbf{36}_2$ within the data driver $\mathbf{2}_2$ are set to "+A'" and "+B'", respectively, while the serially-connected resistors 32 are composed of 63 resistors having the same resistance of R; it should be noted that such assumption is made only for simplicity, although the resistances of the respective resistors within the serially-connected resistors 32 are actually determined in accordance with desired gamma characteristics. In this case, the grayscale voltage $V_2^+$ actually developed on the serially-connected resistors 32 within the data driver $\mathbf{2}_1$ is represented as follows:

$$V_2^+ = 2(V_H^+ + A)/63 + 61(V_L^+ + B)/63,$$
$$= V_2^{+*} + 2A/63 + 61B/63,$$

while the grayscale voltage $V_2^{+'}$ actually developed on the serially-connected resistors 32 within the data driver $\mathbf{2}_2$ is represented as follows:

$$V_2^{+'} = 2(V_H^+ + A')/63 + 61(V_L^+ + B')/63,$$
$$= V_2^{+*} + 2A'/63 + 61B'/63.$$

The attached apostrophes indicate that the quantities are related to the data driver $\mathbf{2}_2$. As is understood from these formulas, the offset voltages of the amplifiers $\mathbf{36}_1$ and $\mathbf{36}_2$ causes the actually generated grayscale voltages $V_2^+$ and $V_2^{+'}$ to be different from the desired grayscale voltage $V_2^{+*}$. Since the offset voltages A and A' are different from each other and the offset voltages B and B' are different from each other, the positive grayscale voltages $V_2^+$ generated by the data drivers $\mathbf{2}_1$ and $\mathbf{2}_2$ in response to the display data of "2" are different.

The same applies to the negative grayscale voltage $V_2^-$. When the offset voltages of the amplifiers $\mathbf{37}_1$ and $\mathbf{37}_2$ within the data driver $\mathbf{2}_1$ are set to "+C" and "+D", respectively, and the offset voltages of the amplifiers $\mathbf{37}_1$ and $\mathbf{37}_2$ within the data driver $\mathbf{2}_2$ are set to "+C'" and "+D'", the grayscale voltage $V_2^-$ actually developed on the serially-connected resistors 34 within the data driver $\mathbf{2}_1$ is represented as follows:

$$V_2^- = 2(V_L^- + C)/63 + 61(V_H^- + D)/63,$$
$$= V_2^{-*} + 2C/63 + 61D/63,$$

while the grayscale voltage $V_2^{-'}$ actually developed on the serially-connected resistors 34 within the data driver $\mathbf{2}_2$ is represented as follows:

$$V_2^{-'} = 2(V_L^- + C')/63 + 61(V_H^- + D')/63,$$
$$= V_2^{-*} + 2C'/63 + 61D'/63.$$

As is understood from these formulas, the offset voltages of the amplifiers $\mathbf{37}_2$ and $\mathbf{37}_2$ causes the actually generated grayscale voltages $V_2^-$ and $V_2^{-'}$ to be different from the desired grayscale voltage $V_2^{-*}$. Since the offset voltages C and C' are different from each other and the offset voltages D and D' are different from each other, the negative grayscale voltages $V_2^-$ generated by the data drivers $\mathbf{2}_1$ and $\mathbf{2}_2$ in response to the display data of "2" are different.

As thus described, the actual grayscale voltages $V_2^+$ and $V_2^-$ are different from the desired values $V_2^{+*}$ and $V_2^{-*}$, respectively, due to the offset voltages of the amplifiers 36, and the errors from the desired values $V_2^{+*}$ and $V_2^{-*}$ are different between the data drivers $\mathbf{2}_1$ and $\mathbf{2}_2$. Specifically, the data drivers $\mathbf{2}_1$ outputs data signals having a voltage level of $V_2^{+*}$+a, while the data drivers $\mathbf{2}_2$ outputs data signals having a voltage level of $V_2^{+*}$+a', where a and a' are the errors from the desired values $V_2^{+*}$, which are determined on the offset voltages "+A" and "+B" of the amplifiers $\mathbf{36}_1$ and $\mathbf{36}_2$. In general, the errors a and a' are different from each other, because the characteristics of the amplifiers $\mathbf{36}_1$ and $\mathbf{36}_2$ are different.

In the second frame period, the data driver $\mathbf{2}_1$ outputs data signals having a voltage level of $V_2^{-*}$+d, while the data driver $\mathbf{2}_2$ outputs data signals having a voltage level of $V_2^{-*}$+d', where d and d' are the errors from the desired values $V_2^{-*}$, which are determined on the offset voltages "+C" and "+D" of the amplifiers $\mathbf{36}_1$ and $\mathbf{36}_2$. In general, the errors d and d' are different from each other, because the characteristics of the amplifiers $\mathbf{37}_1$ and $\mathbf{37}_2$ are different.

If the same operations as the first and second frame periods are repeated in the following frame periods with the polarities of the offset voltages of the amplifiers 36 and 37 kept unchanged, the differences between a and a' and between d and d' are observed as the grayscale levels of the pixels; this causes the grayscale levels of the pixels driven by the data driver $\mathbf{2}_1$ to be slightly different from the grayscale levels of the pixels driven by the data driver $\mathbf{2}_2$. This results in that the "inter-block unevenness" is observed over the liquid crystal display panel 1.

In this embodiment, the errors of the voltage levels of the data signals from the desired values, which are caused by the offset voltages of the amplifiers 36 and 37, are cancelled within each data driver 2 through inverting the polarities of the offset voltages of the amplifiers 36 and 37. Specifically, the offset voltages of the amplifiers $\mathbf{36}_1$ and $\mathbf{36}_2$ are set to "−A" and "−B", respectively, in the third frame period, to have the polarities opposite to those in the first frame period. Therefore, the data driver $\mathbf{2}_1$ outputs data signals having a voltage level of $V_2^{+*}$−a, while the data driver $\mathbf{2}_2$ outputs data signals having a voltage level of $V_2^{+*}$−a'. In the fourth frame period, the offset voltages of the amplifiers $\mathbf{37}_1$ and $\mathbf{37}_2$ are set to "−C" and "−D", respectively, to have the polarities opposite to those in the second frame period. Therefore, the data driver $\mathbf{2}_1$ outputs data signals having a voltage level of $V_2^{-*}$−d, while the data driver $\mathbf{2}_2$ outputs data signals having a voltage level of $V_2^{-*}$−d'. The operations in the first to fourth frame periods are repeated in the following frame periods.

Such operations allows the grayscale levels of the pixels driven by the data driver $\mathbf{2}_1$ to be virtually identical to the grayscale levels of the pixels driven by the data driver $\mathbf{2}_2$ in terms of the time average, and thereby reduces the "inter-block unevenness". In detail, the errors of the voltage levels of the positive data signals generated by the data drivers $\mathbf{2}_1$ and $\mathbf{2}_2$ for the display data of "2" are canceled between the (4j+1) and (4j+3) frame periods. Therefore, the voltage levels of the positive data signals generated by the data drivers $\mathbf{2}_1$ and $\mathbf{2}_2$ for the display data of "2" are virtually identical to the desired value $V_2^{+*}$ in terms of the time average. Correspondingly, the voltage levels of the negative data signals generated by the data drivers $\mathbf{2}_1$ and $\mathbf{2}_2$ for the display data of "2" are virtually identical to the desired value $V_2^{-*}$ in terms of the time average. Therefore, the grayscale level of a pixel driven by the data driver $\mathbf{2}_1$ is ideally identical to that of a driven by the data driver $\mathbf{2}_2$ for the same display data, and this effectively avoids the "inter-block unevenness".

In actual, the magnitudes of the offset voltages of the amplifiers 36 and 37 may depend on the polarities of the offset voltages, and this may result in that the "inter-block unevenness" is not completely avoided; however, it is easily understood by those skilled in the art that the "inter-block unevenness" is effectively reduced even when the magnitudes of the offset voltages of the amplifiers 36 and 37 are different depending on the polarities thereof.

One issue of the operation shown in FIG. 9A, in which the offset voltages of the amplifiers 36 and 37 are switched every two frame periods, is that the grayscale levels of the respective pixels may be largely changed every two frame periods when the offset voltages are large. This may be observed as flicker on the liquid crystal display panel 1.

Figure 9B:
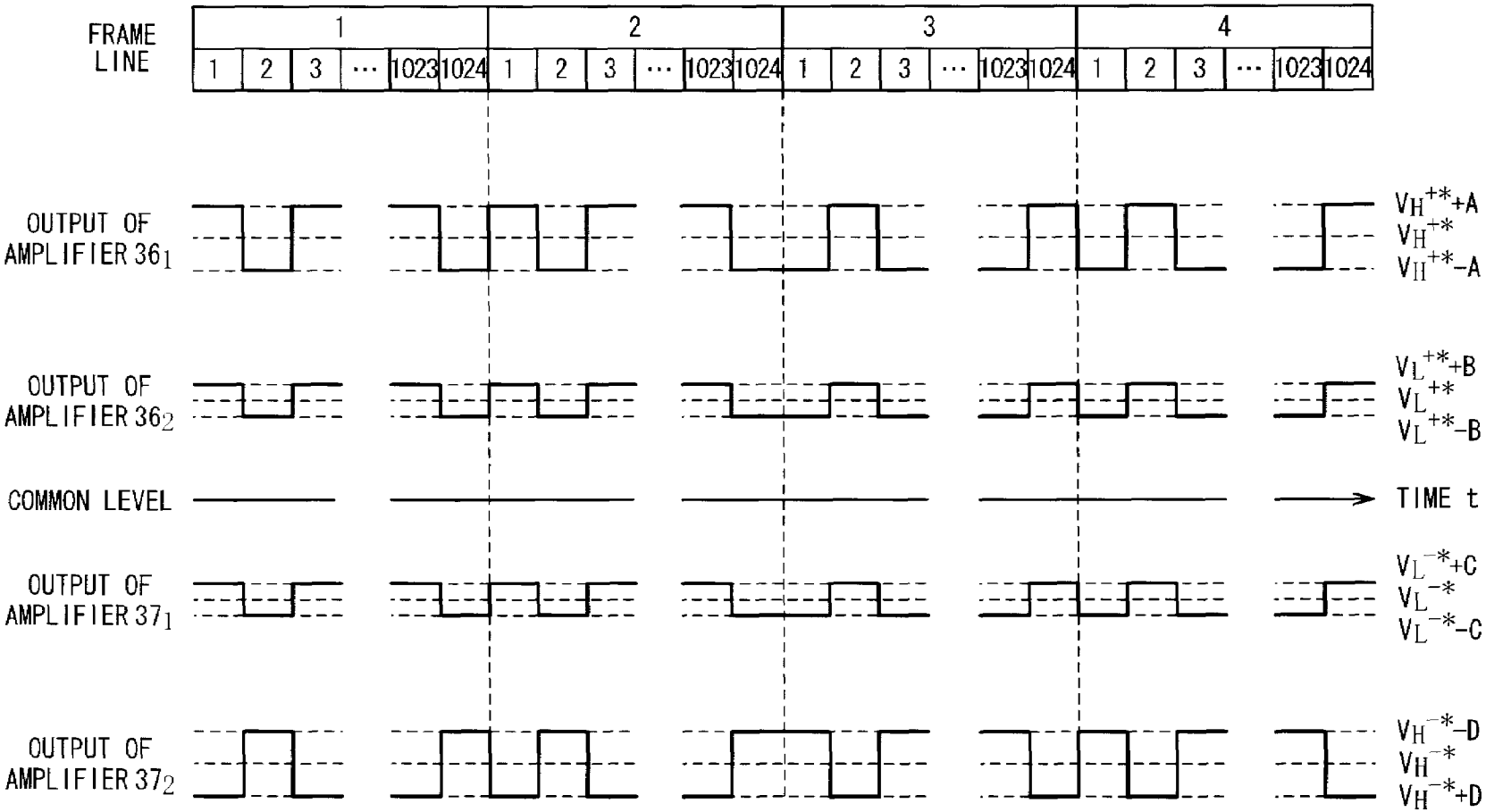
FIG. 9B is a timing chart illustrating a further preferred control method of the polarities of the offset voltages of the amplifiers and the polarities of data signals.

It is preferable for the reduction of the flicker that the pixels within the liquid crystal display panel 1 are driven so that the polarities of the offset voltages of the amplifiers are opposite between adjacent lines. FIG. 9B illustrates the operation of the data driver 2 for the case when the polarities of the offset voltages of the amplifiers are inverted between adjacent lines. Although FIG. 9B illustrates the operation for the case when the liquid crystal display panel 1 supports SXGA (super extended graphic array), in which the number of the lines is 1024, those skilled in the art would appreciate that the number of the lines is not limited to 1024.

In the first and second frame periods, the offset voltages of the amplifiers $\mathbf{36}_1$, $\mathbf{36}_2$, $\mathbf{37}_1$ and $\mathbf{37}_2$ are set to "+A", "+B", "+C" and "+D", respectively, in driving the pixels in the odd lines, while the offset voltages of the amplifiers $\mathbf{36}_1$, $\mathbf{36}_2$, $\mathbf{37}_1$ and $\mathbf{37}_2$ are set to "−A", "−B", "−C" and "−D", respectively, in driving the pixels in the even lines. In the third and fourth frame periods, the offset voltages of the amplifiers $\mathbf{36}_1$, $\mathbf{36}_2$, $\mathbf{37}_1$ and $\mathbf{37}_2$ are set to "−A", "−B", "−C" and "−D", respectively, in driving the pixels in the odd lines, while the offset voltages of the amplifiers $\mathbf{36}_1$, $\mathbf{36}_2$, $\mathbf{37}_1$ and $\mathbf{37}_2$ are set to "+A", "+B", "+C" and "+D", respectively, in driving the pixels in the even lines. The operations in the first to fourth frame periods are repeated in the following frame periods. According to this operation, the polarities of the offset voltages of the amplifiers 36 and 37 are inverted between adjacent line, while the polarities of the offset voltages of the amplifiers 36 and 37 are inverted every two frame periods for each line.

As thus described, the display device in this embodiment effectively reduces the "inter-block unevenness" through inverting the polarities of the offset voltages of the amplifiers within the grayscale generation power supply circuit. Additionally, the display device in this embodiment effectively reduces the flicker through inverting the he polarities of the offset voltages of the amplifiers between adjacent line.

Figure 11:
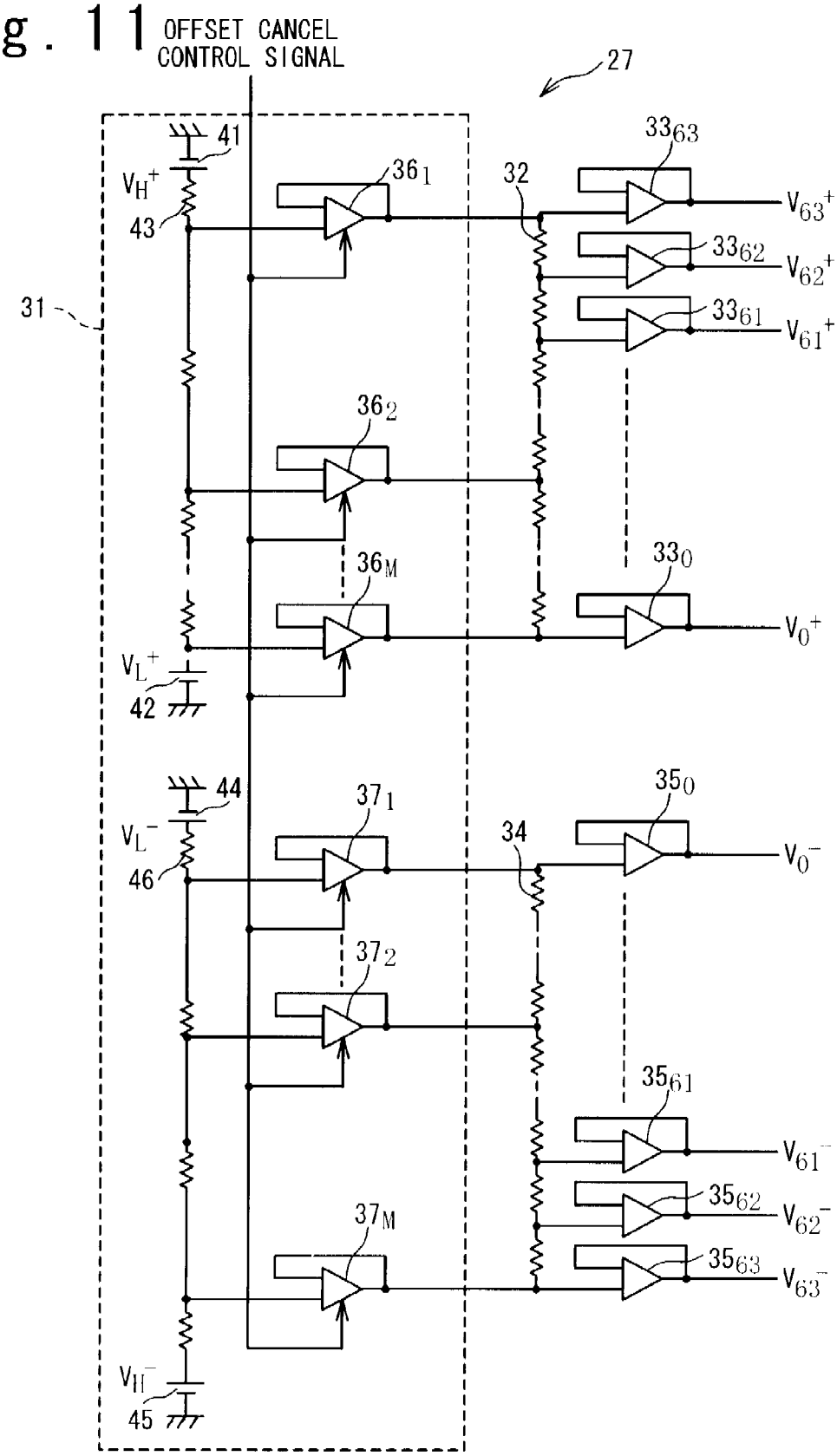
FIG. 11 is a circuit diagram illustrating another allowed configuration of the grayscale voltage generator circuit within the data driver 6 shown in FIG. 6.

It should be noted that the configuration of the grayscale generation power supply circuit may be modified variously. It should be especially noted that the reduction of the "inter-block unevenness" through inverting the polarities of the offset voltages of the amplifiers is also effective for the case when the number of the amplifiers within the grayscale generation power supply circuit is not two. As shown in FIG. 11, for example, the grayscale generation power supply circuit 1 within each data driver 2 may be provided with constant voltage sources 41, 42, 44, 45, serially-connected resistors 43, 44, amplifiers $\mathbf{36}_1$ to $\mathbf{36}_M$ and amplifiers $\mathbf{37}_1$ to $\mathbf{37}_M$, where M is an integer equal to or larger than three. The inversion of the offset voltages of the respective amplifiers 36 and 37 at a certain cycle is also applicable to this case for the reduction of the "inter-block unevenness".

Second Embodiment

Figure 12:
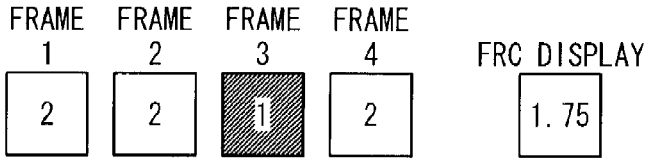
FIG. 12 is a conceptional diagram illustrating an example of the frame rate control.

In a second embodiment, the pseudo multiple grayscale display is achieved by a frame rate control (FRC) technique. The frame rate control is a technique that virtually achieves the grayscale display with many grayscale levels by changing a grayscale level of a pixel at a cycle of a predetermined number of frame periods, as shown in FIG. 12. FIG. 12 illustrates an example of a frame rate control technique with a cycle of four frame periods. In the frame rate control shown in FIG. 12, the display data is set to a value of "2" in the Frames 1, 2 and 4, while the display data is set to a value of "1" in the Frame 3. This achieves pseudo grayscale display for a display data of "1.75".

Figure 13:
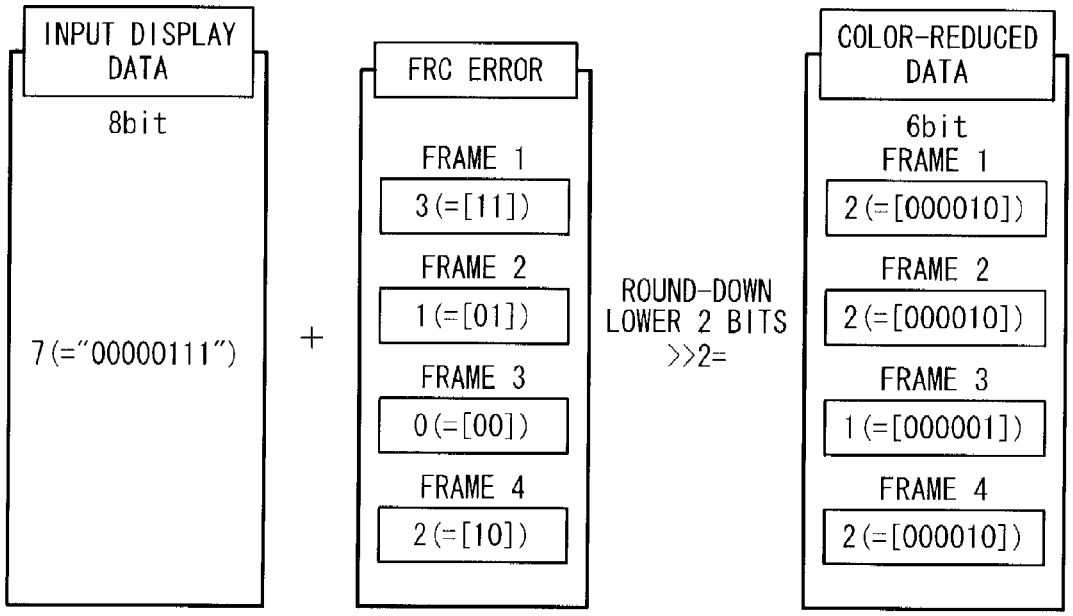
FIG. 13 is a concept diagram illustrating a method of generating color-reduced data adapted to the frame rate control.
Figure 14:
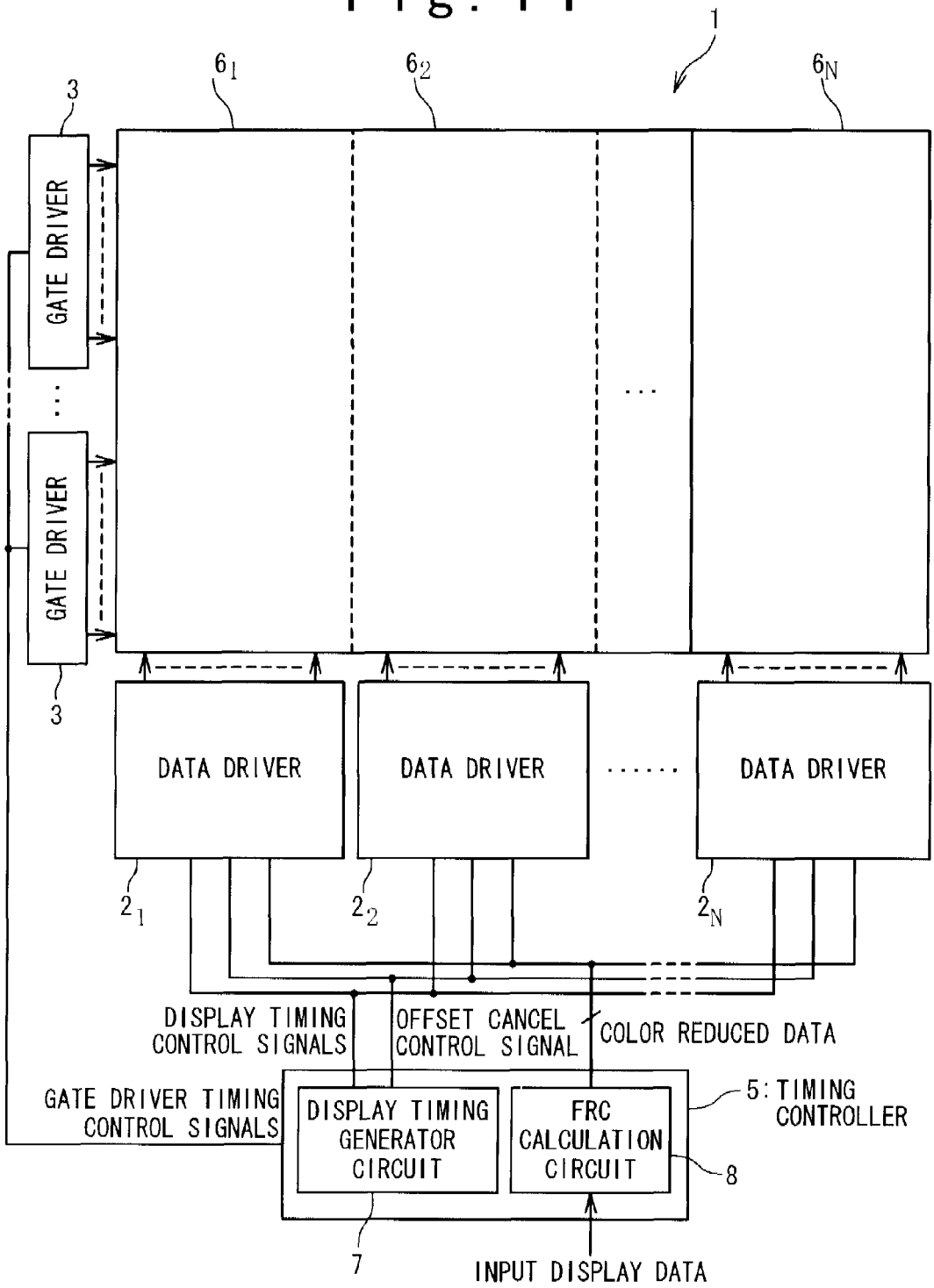
FIG. 14 is a block diagram illustrating the structure of a display device in a second embodiment of the present invention.

The frame rate control technique is often accompanied by color reduction. Let us consider the case when display data externally provided for the timing controller 5 are 8-bit data, while the data drivers 2 are only adapted to 6-bit display data, as shown in FIG. 13. In this case, 6-bit display data are generated through two-bit color reduction from 8-bit display data, and the signal lines are driven in response to the 6-bit display data generated. In the following, display data externally provided for the timing controller 5 are referred to as "input display data", and display data generated by color reduction are referred to as "color-reduced data", if necessary for distinction.

The color-reduced data is generated in accordance with the frame rate control so that 8-bit grayscale display is virtually achieved using 6-bit color-reduced data. The color reduction may be achieved by ordered dithering, which generates color-reduced data using a dither matrix for generating, or error diffusion, which generates color-reduced data of a target pixel using an error between input display data and color-reduced data of a nearby pixel.

FIG. 13 illustrates an example of color reduction for a specific pixel, more specifically, 2-bit color reduction for 8-bit input display data having a value of "7". In the color reduction for the specific pixel, color-reduced data is generated through calculating a sum of 8-bit input display data and a 2-bit FRC error (or noise), and rounding down the lower two bits of the obtained sum. In the process shown in FIG. 13, the FRC error is selected from "00", "01", "10" and "11", and the FRC error is cyclically switched among these four values. When ordered dithering is used for the color reduction, the switching of the FRC error is achieved by changing the used dither matrix. When error diffusion is used, on the other hand, the switching of the FRC error is achieved by periodically changing the initial value defined for the left-end pixel of each line.

In order to achieve frame rate control, the timing controller 5 within the display device of this embodiment includes an FRC calculation circuit 8. The FRC calculation circuit 8 generates 6-bit color-reduced data from 8-bit input display data, and provides the generated 6-bit color-reduced data for the data drivers 2. The data register circuit 22 within each data driver 2 received the 6-bit color-reduced data from the FRC calculation circuit 8. The color-reduced data are forwarded to the D/A converter 25 through the latch circuit 23 and the level shifter circuit 24, and data signals having voltage levels corresponding to the color-reduced data are generated by the D/A converter 25 and the output amplifiers 26. Except for this modification, the display device in the second embodiment is structured identically to that in the first embodiment. As described above, it is of significance that the amplifiers 36 and 37 within the grayscale generation power supply circuit 31 are designed so that the polarities of the offset voltages thereof are reversible in response to the offset cancel control signal.

Figure 15A:
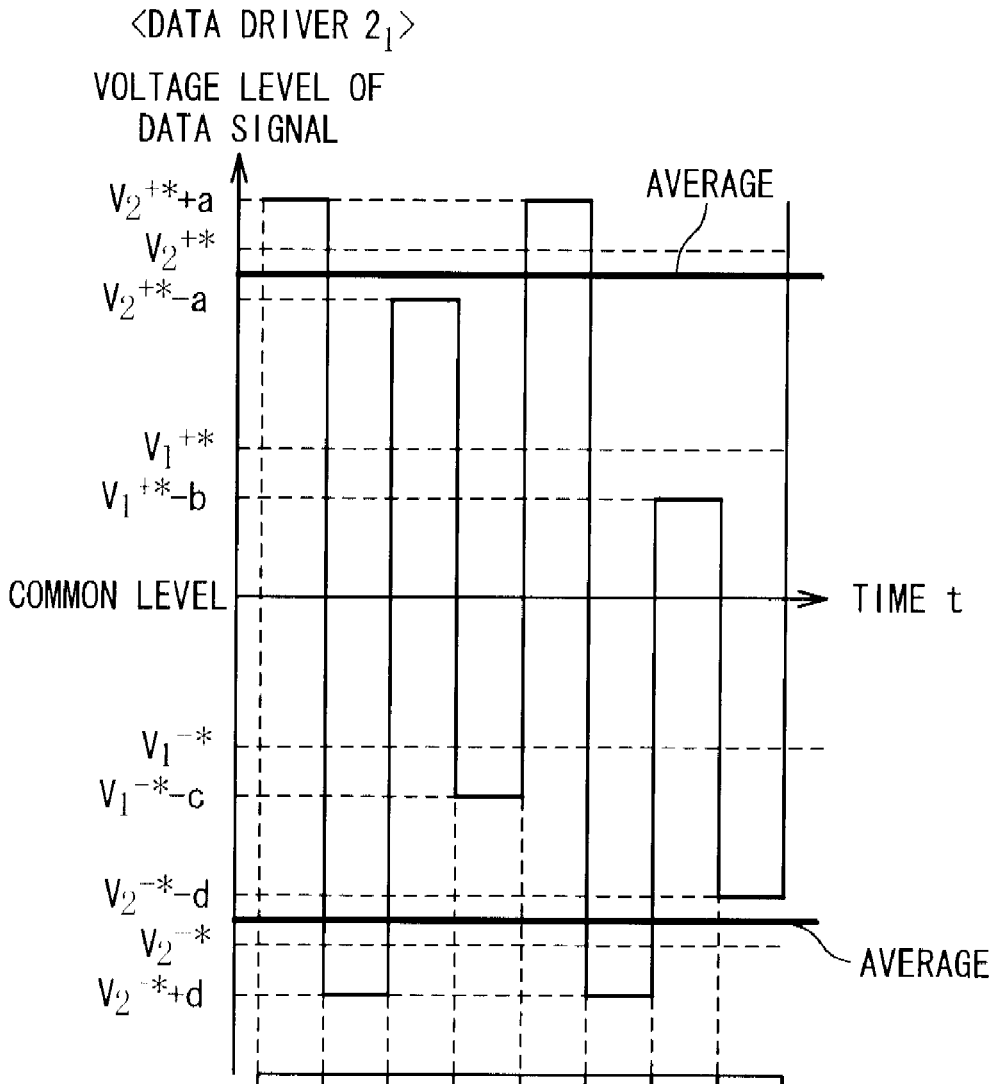
FIGS. 15A and 15B are timing charts illustrating an undesirable operation of data drivers, in which the frame rate control and the switching control of the polarities of the offset voltages of the amplifiers are inappropriately implemented.
Figure 15B:
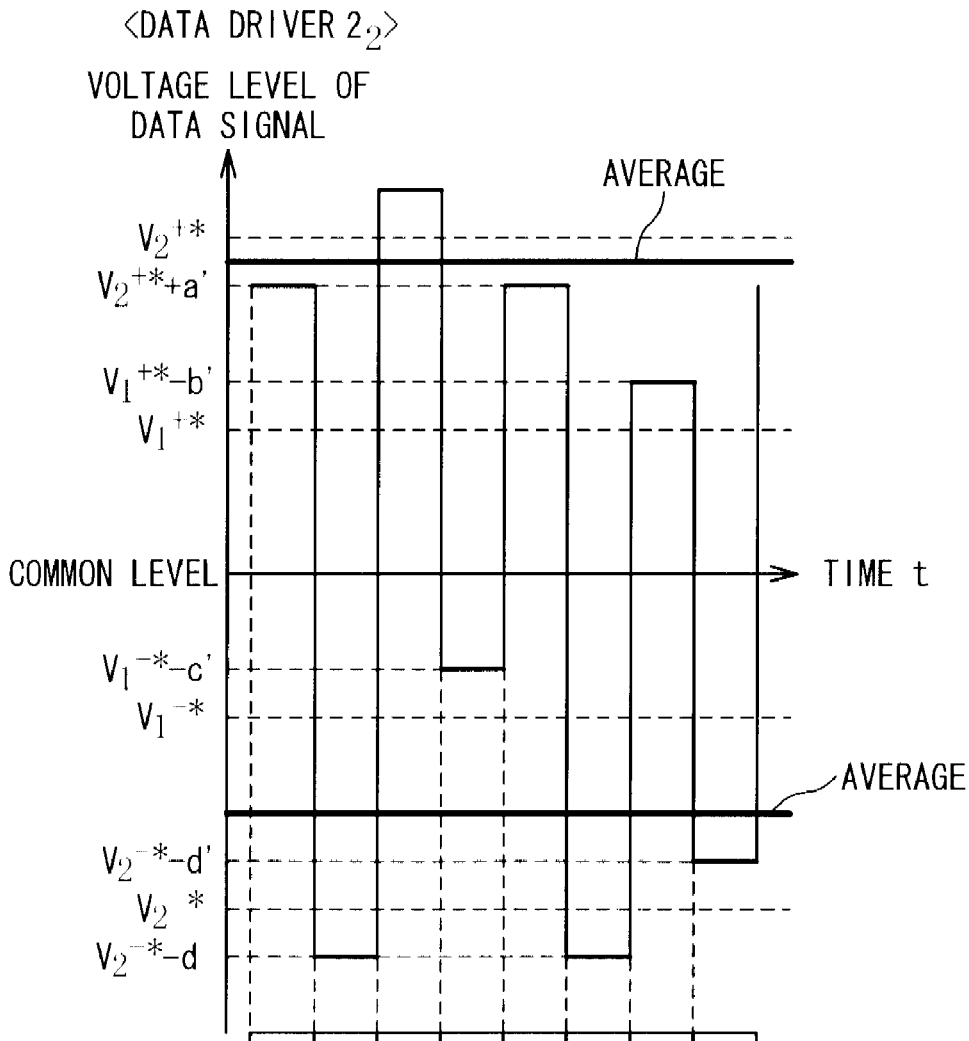

One issue is that the "inter-block unevenness" may undesirably occur when the frame rate control is implemented in an inappropriate manner in combination with the control of the polarities of the offset voltages of the amplifiers 36 and 37. FIGS. 15A and 15B are timing charts illustrating the cause of the inter-block unevenness due to an inappropriate control.

An assumption is made in the following discussion that the polarity of a data signal fed to a specific pixel is inverted every frame period, and the FRC error is cyclically switched at a cycle of 8 ($=2^2\times2$) frame periods, while the polarities of the offset voltages of the amplifiers 36 and 37 are switched every two frame periods (that is, at a cycle of four frame periods). The cycle of eight frame periods in the frame rate control is based on the fact that all the possible combinations of the polarities of the data signal and the allowed values of FRC error should be covered in every control cycle.

The operation shown in FIGS. 15A and 15B, however, undesirably results in that the actual grayscale levels of pixels for the same display data are slightly different between different data drivers 2. The slight difference in the actual grayscale levels is visually observed as the "inter-block unevenness".

Let us consider the case, for example, in which the data drivers $\mathbf{2}_1$ and $\mathbf{2}_2$ each drive a pixel in first to eight frame periods in response to a series of display data of "2", "2", "2", "1", "2", "2", "1" and "2".

In this case, as shown in FIG. 15A, the data driver $\mathbf{2}_1$ outputs a series of data signals having voltage levels of "$V_2^{+}$*+a", "$V_2^{-}$*+d", "$V_2^{+}$*−a", "$V_1^{-}$*−c", "$V_2^{+}$*+a", "$V_2^{-}$*+d", "$V_1^{+}$*−b" and "$V_2^{-}$*−d", in first to eight frame periods, respectively, where "+a", "+b", "+c" and "+d" are errors of the voltage levels of the data signals caused by the offset voltages of the amplifiers $\mathbf{36}_1$, $\mathbf{36}_2$, $\mathbf{37}_1$ and $\mathbf{37}_2$ within the data driver $\mathbf{2}_1$ being set to "+A", "+B", "+C" and "+D", respectively, while "−a", "−b", "−c" and "−d" are errors of the voltage levels of the data signals caused by the offset voltages of the amplifiers $\mathbf{36}_1$, $\mathbf{36}_2$, $\mathbf{37}_1$ and $\mathbf{37}_2$ within the data driver $\mathbf{2}_1$ being set to "−A", "−B", "−C" and "−D".

Correspondingly, as shown in FIG. 15B, the data driver $\mathbf{2}_2$ outputs a series of data signals having voltage levels of "$V_2^{+}$*+a'", "$V_2^{-}$*+d'", "$V_2^{+}$*−a'", "$V_1^{-}$*−c'", "$V_2^{+}$*+a'", "$V_2^{-}$*+d'", "$V_1^{+}$*−b'" and "$V_2^{-}$*−d'", in first to eight frame periods, respectively, where "+a'", "+b", "+c" and "+d" are errors of the voltage levels of the data signals caused by the offset voltages of the amplifiers $\mathbf{36}_1$, $\mathbf{36}_2$, $\mathbf{37}_1$ and $\mathbf{37}_2$ within the data driver $\mathbf{2}_2$ being set to "+A'", "+B'", "+C'" and "+D'", respectively, while "−a", "−b'", "−c'" and "−d'" are errors of the voltage levels of the data signals caused by the offset voltages of the amplifiers $\mathbf{36}_1$, $\mathbf{36}_2$, $\mathbf{37}_1$ and $\mathbf{37}_2$ within the data driver $\mathbf{2}_2$ being set to "−A'", "−B'", "−C'" and "−D".

In this operation, the average of the voltage levels of the positive data signals outputted from the data drivers $\mathbf{2}_1$ and $\mathbf{2}_2$ is different between the data drivers $\mathbf{2}_1$ and $\mathbf{2}_2$. Specifically, the average of the voltage levels of the positive data signals outputted from the data driver $\mathbf{2}_1$ is $\{(3V_2^{+*}+V_1^{+*})/4\}+(a-b)/4$, while the average of the voltage levels of the positive data signals outputted from the data driver $\mathbf{2}_2$ is $\{(3V_2^{+*}+V_1^{+*})/4\}+(a'-b')/4$. Since the errors a and a' are different in general and the errors b and b' are different in general, the average of the voltage levels of the positive data signals is different between the data drivers $\mathbf{2}_1$ and $\mathbf{2}_2$. It would be easily understood from similar calculation that the average of the voltage levels of the negative data signals is also different between the data drivers $\mathbf{2}_1$ and $\mathbf{2}_2$.

The difference in the average of the voltage levels of the data signals causes difference in the grayscale levels of the pixels, and may be visually observed as the "inter-block unevenness". Therefore, the operation shown in FIGS. 15A and 15B may suffer from the "inter-block unevenness".

Figure 16:
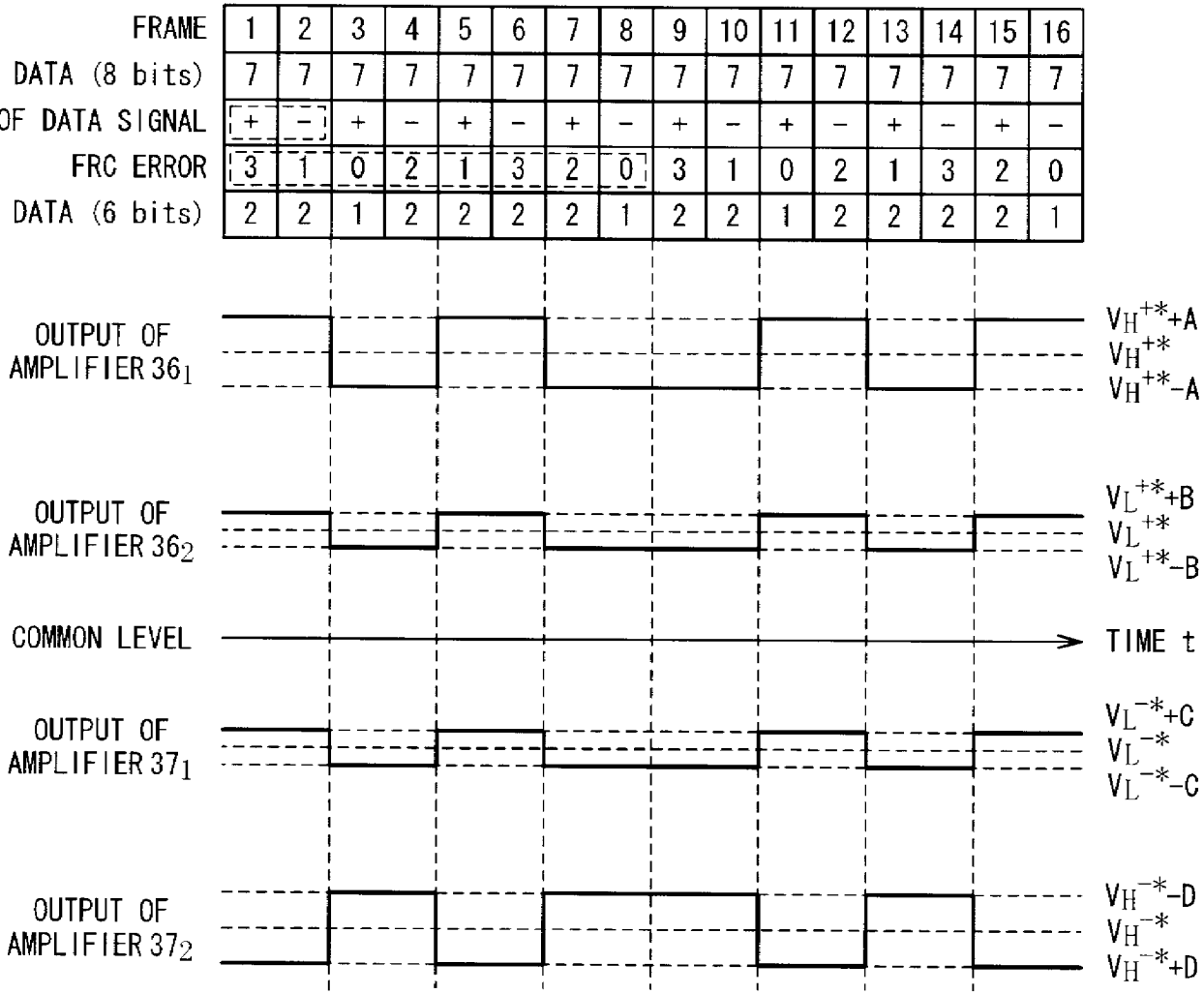
FIG. 16 is a timing chart illustrating a preferred control method of the switching of the FRC errors and the polarities of the offset voltages of the amplifiers.

This problem can be resolved by controlling the polarities of the data signals, the values of the FRC errors, and the polarities of the offset voltages of the amplifiers 36 and 37 so that all the possible combinations thereof are covered in every control cycle. FIG. 16 is a diagram illustrating a control satisfying this requirement. When 2-bit color reduction is implemented, there are 16 ($=2^2\times2\times2$) possible combinations of the polarities of the data signals, the values of the FRC errors, and the polarities of the offset voltages of the amplifiers 36 and 37; there are four ($=2^2$) allowed values for the FRC errors, two allowed polarities for the data signals, and two allowed polarities for the offset voltages of the amplifiers 36 and 37. In this embodiment, the polarities of the data signals, the values of the FRC errors, and the polarities of the offset voltages of the amplifiers 36 and 37 are cyclically controlled at a cycle of 16 frame periods, to allow tall the possible combinations thereof to be covered in every control cycle.

More specifically, in the control shown in FIG. 16, the polarities of the data signals are switched every frame period, while the FRC errors are cyclically changed at a cycle of 8 ($=2^2\times2$) frame periods. The polarities of the offset voltages of the amplifiers 36 and 37 are cyclically controlled at a cycle of 16 frame periods. In detail, the polarities of the offset voltages of the amplifiers 36 and 37 are inverted every two frame periods in the former half of the control cycle, that is, in the first to eight ($=2^2\times2$) frame periods. In the latter half of the control cycle, that is, in the ninth ($=2^2\times2+1$) to 16th ($=2^2\times2\times2$) frame periods, the polarities of the offset voltages of the amplifiers 36 and 37 are set to be opposite to those in the first to eight ($=2^2\times2$) frame periods, respectively. Such control results in that all the possible combinations of the polarities of the data signals, the values of the FRC errors, and the polarities of the offset voltages of the amplifiers 36 and 37 are covered in every control cycle.

Such operation effectively reduces the "inter-block unevenness", as is understood from the following discussion. In the following discussion, an assumption is made that an image in which all the pixels are set to the same grayscale level for a sufficiently long duration. It should be noted that the display device suffers from the "inter-block unevenness" most severely when all the pixels are set to the same grayscale level.

Figure 17A:
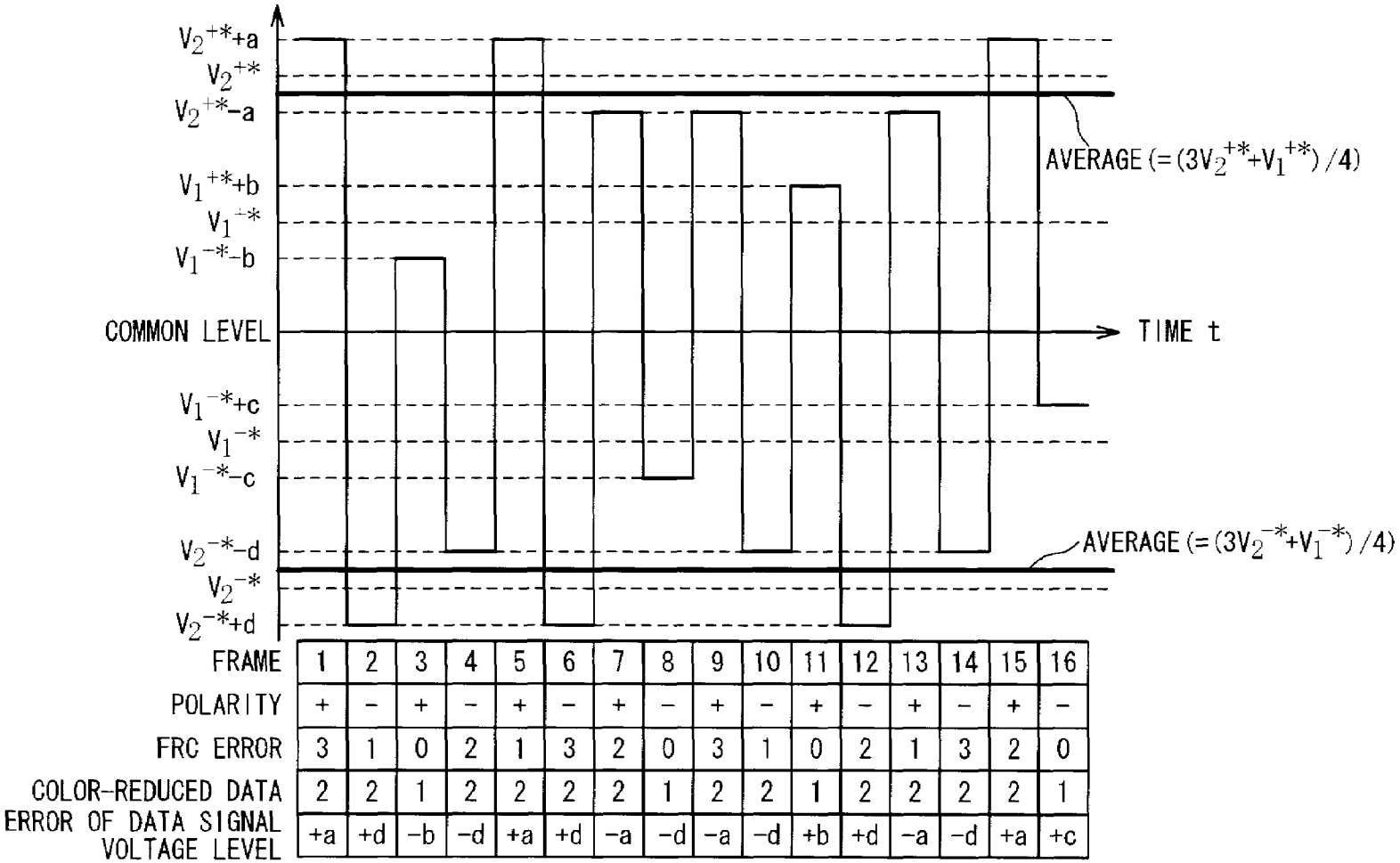
FIG. 17A is a timing chart illustrating the operation of a certain data driver in the case when the control shown in FIG. 16 is implemented.
Figure 17B:
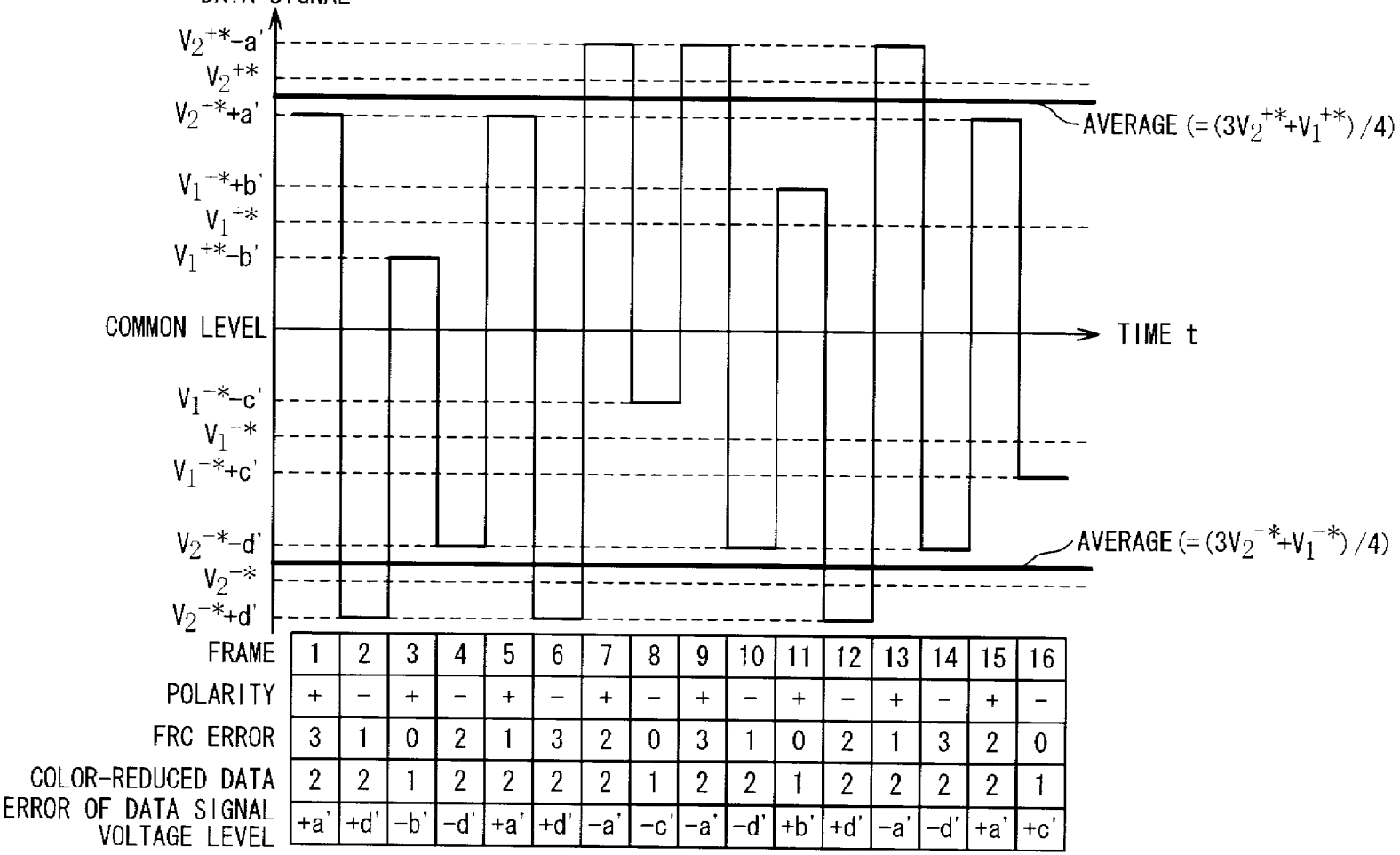
FIG. 17B is a timing chart illustrating the operation of another data driver in the case when the control shown in FIG. 16 is implemented.

FIG. 17A is a diagram illustrating voltage levels of data signals outputted from the data driver $\mathbf{2}_1$ when the control shown in FIG. 16 is implemented, while the FIG. 17B is a diagram illustrating voltage levels of data signals outputted from the data driver $\mathbf{2}_2$. In FIGS. 17A and 17B, "$V_2^{+}$*" and "$V_2^{-}$*" indicate desired values of positive and negative grayscale voltages corresponding to color-reduced data having a value of "2", respectively, and "$V_1^{+}$*" and "$V_1^{-}$*" indicate desired values of positive and negative grayscale voltages corresponding to color-reduced data having a value of "1".

As is understood from FIGS. 17A and 17B, the operation shown in FIG. 16 effectively cancels the errors of the voltage signals of the data signals caused by the offset voltages of the amplifiers 36 and 37 for all the possible combinations of the polarities of the data signals and the values of the color-reduced data.

For the voltage level of a positive data signal corresponding to color-reduced data having a value of "2", for example, the data driver $\mathbf{2}_1$ outputs the positive data signals having a voltage level of "$V_2^{+}$*+a" three times, and also outputs the positive data signals having a voltage level of "$V_2^{+}$*−a", three times; the number of times in which the data driver $\mathbf{2}_1$ outputs the positive data signals having a voltage level of "$V_2^{+}$*+a" is identical to the number of times in which the data driver $\mathbf{2}_1$ outputs the positive data signals having a voltage level of "$V_2^{+}$*−a". Therefore, the errors "+a" and "−a" of the voltage levels of the data signals corresponding to the color-reduced data having a value of "2" are cancelled. For the voltage level of a positive data signal corresponding to color-reduced data having a value of "1", on the other hand, the data driver $\mathbf{2}_1$ outputs the positive data signals having a voltage level of "$V_1^{+*}+b$" once, and also outputs the positive data signals having a voltage level of "$V_1^{+*}-b$" once; the number of times in which the data driver $\mathbf{2}_1$ outputs the positive data signals having a voltage level of "$V_1^{+*}+b$" is identical to the number of times in which the data driver $\mathbf{2}_1$ outputs the positive data signals having a voltage level of "$V_1^{+*}-b$". Therefore, the errors "+b" and "−b" of the voltage levels of the data signals corresponding to the color-reduced data having a value of "1" are cancelled. As a result, the average of the voltage levels of the positive data signals outputted from the data driver $\mathbf{2}_1$ is $\{(3V_2^{+*}+V_1^{+*})/4\}$.

The same goes for the negative data signals. The errors "+c" and "−c" of the voltage levels of the data signals are cancelled therebetween, while the errors "+d" and "−d" of the voltage levels of the data signals are cancelled therebetween. As a result, the average of the voltage levels of the negative data signals outputted from the data driver $\mathbf{2}_1$ is $\{(3V_2^{-*}+V_1^{-*})/4\}$.

The same applies to the data driver $\mathbf{2}_2$, which exhibits different errors "±a'", "±b", "±c'" and "±d'" in the generated data signals. The average of the voltage levels of the negative data signals outputted from the data driver $\mathbf{2}_2$ is also $\{(3V_2^{-*}+V_1^{-*})/4\}$.

Therefore, the grayscale level of a pixel driven by the data driver $\mathbf{2}_1$ is ideally identical to the grayscale level of a pixel driven by the data driver $\mathbf{2}_2$ for the same display data, which effectively avoids the "inter-block unevenness".

As thus described, the problem of the "inter-block unevenness" for the frame rate control is effectively resolved through controlling the polarities of data signals, the FRC errors and the polarities of the offset voltages of the amplifiers 36 and 37 so that all the possible combinations thereof are covered in every control cycle. Generally, the polarities of data signals, the FRC errors and the polarities of the offset voltages of the amplifiers 36 and 37 are controlled at a cycle of $(2^n\times2\times2)$ frame periods when n-bit color reduction is implemented to generate color-reduced data, because there are $2^n$ allowed values for the FRC errors used for the n-bit color reduction.

Figure 18:
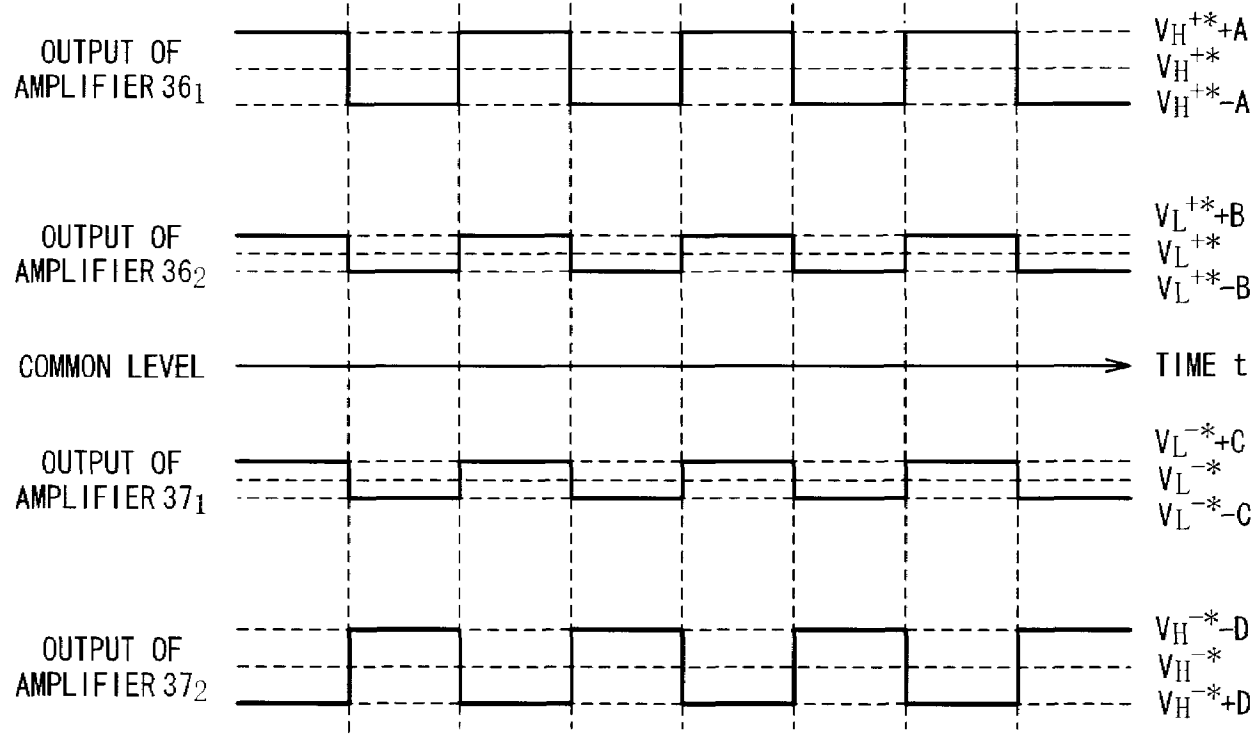
FIG. 18 is a timing chart illustrating another preferred control method of the polarities of the data signals, the polarities of the offset voltages of the amplifiers and the FRC errors.

FIG. 18 is a diagram illustrating another exemplary operation for controlling the polarities of data signals, the FRC errors and the polarities of the offset voltages of the amplifiers 36 and 37 so that all the possible combinations thereof are covered in every control cycle. In the control shown in FIG. 18, the polarities of the data signals are inverted every frame period, while the offset voltages of the amplifiers 37 and 37 are inverted every two frame periods. The FRC errors are cyclically changed at a cycle of 16 ($=2^2\times4$) frame periods. Such control allows covering all the possible combinations the polarities of data signals, the FRC errors and the polarities of the offset voltages of the amplifiers 36 and 37 in every control cycle, and thereby effectively reduces the "inter-block unevenness".

The difference between the control methods shown in FIGS. 16 and 18 is that the cycle of changing the FRC errors is longer than that of switching the polarities of the offset voltages of the amplifiers 36 and 37 in the control method of FIG. 18. This is not preferable in terms of the flicker. The increase in the duration of the cycle of changing the FRC errors undesirably increases flicker, because the difference between grayscale voltages of adjacent grayscale levels is larger than the errors of the voltage levels of the data signals caused by the offset voltages of the amplifiers 36 and 37. From this viewpoint, the cycle of changing the FRC errors is preferably shorter than the cycle of switching the polarities of the offset voltages of the amplifiers 36 and 37, as illustrated in FIG. 16.

As is the case of the operation shown in FIG. 9A, the pixels are preferably driven so that the polarities of the offset voltages of the amplifiers 36 and 37 are opposite between adjacent lines. Also in this case, it should be noted that the polarities of the offset voltages of the amplifiers 36 and 37 for driving the same line are switched every two frame periods.

It is apparent that the present invention is not limited to the above-described embodiments, which may be modified and changed without departing from the scope of the invention. For example, the display timing generator circuit and the FRC calculation circuit may be integrated within each data driver 2 instead of the timing controller.

Figure 19:
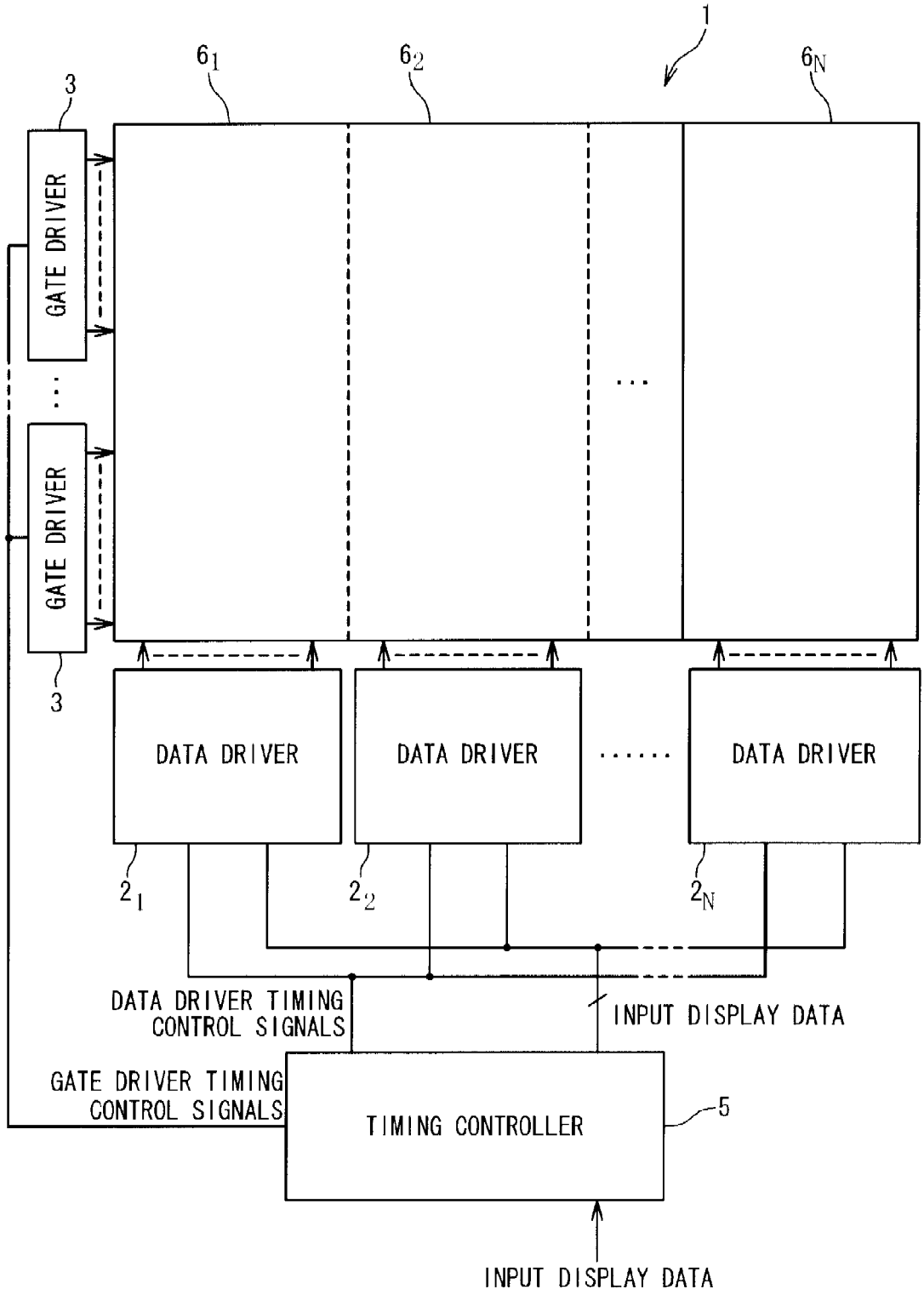
FIG. 19 is a block diagram illustrating another structure of the display device in the second embodiment.
Figure 20:
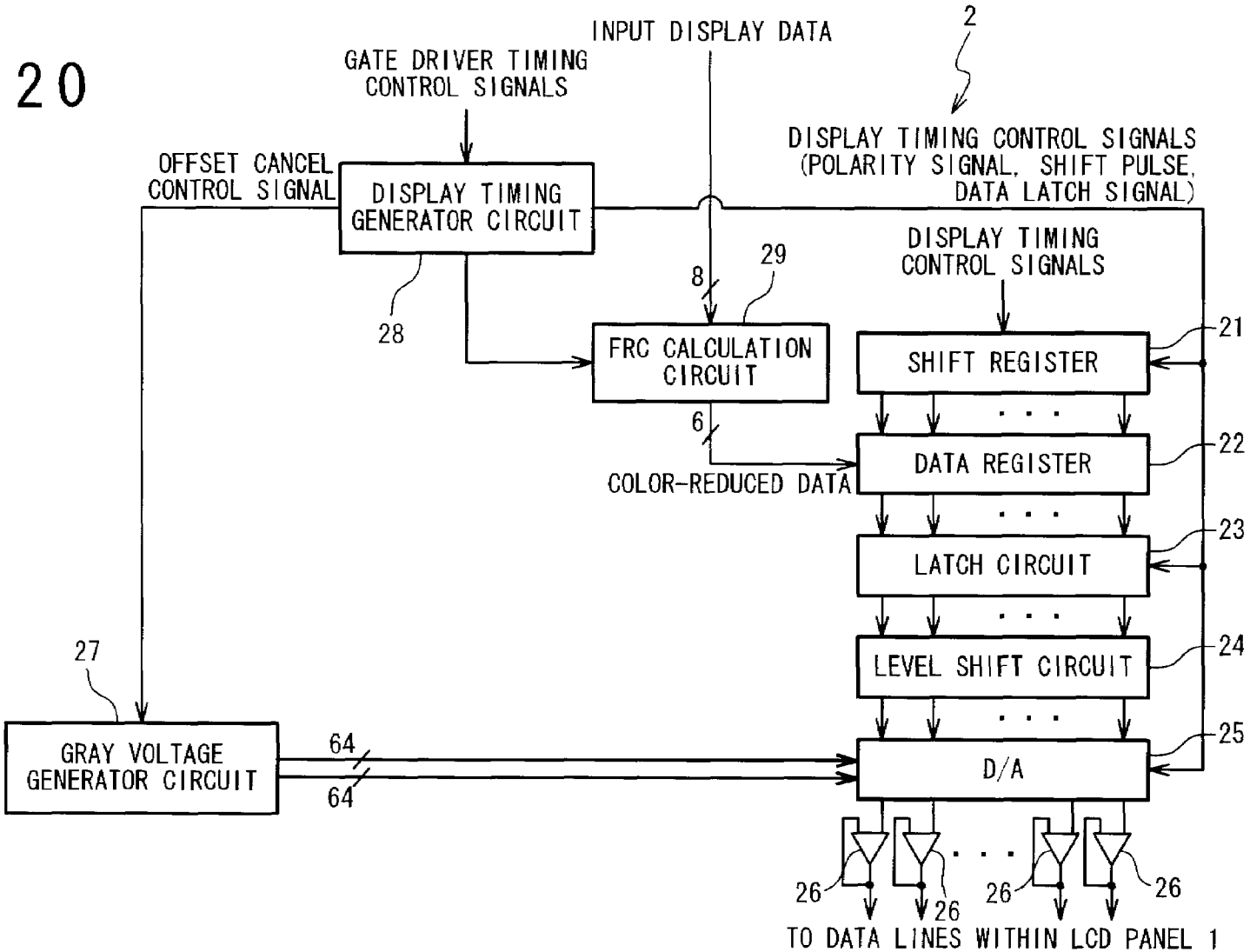
FIG. 20 is a block diagram illustrating another configuration of the data drivers in the second embodiment of the present invention.

FIG. 19 is a block diagram illustrating a display device in which the display timing generator circuit and the FRC calculation circuit are integrated within data drivers 2, and FIG. 20 is a block diagram illustrating the configuration of the data driver 2.

In the display device shown in FIG. 19, the timing controller 5 feeds data driver timing control signals to the respective data drivers 2, to thereby synchronize the operations of the data drivers 2. Additionally, the timing controller 5 forwards externally-provided input display data to the respective data drivers 2.

As shown in FIG. 20, each data driver 2 is provided with a display timing generator circuit 28 and a FRC calculation circuit 29. The display timing generator circuit 28 generates an offset cancel control signal and display timing signals (including a polarity signal, a shift pulse, a data latch signal and so on), in response to the data driver timing control signals received from the timing controller 5. The FRC calculation circuit 29 generates 6-bit color-reduced data from the 8-bit input display data, and feeds the 6-bit color-reduced data to the data register circuit 22. The color-reduced data are forwarded to the D/A converter 25 through the latch circuit 23 and the level shifter circuit 24 and used to generate the data signals.

It should be additionally noted that the present invention is applicable to other display device which drive pixels with voltage drive, although the above description of the embodiments only refers to the display device with the liquid crystal display panel 1.

What is claimed is:

1. A display device comprising:

a display panel including a plurality of pixels are arranged in rows and columns; and a plurality of data drivers connected with said display panel, wherein each of said plurality of data drivers includes:

a grayscale voltage generator circuit generating a plurality of grayscale voltages; and a drive circuitry selecting a grayscale voltage from said plurality of grayscale voltages in response to input display data, and outputting a data signal having a voltage level corresponding to said selected grayscale voltage to said display panel;

wherein said grayscale voltage generator circuit comprises:

an amplifier generating a voltage bias including an offset voltage; and a voltage generator circuit generating said plurality of grayscale voltages from said voltage bias;

wherein:

said amplifier is configured such that a polarity of said offset voltage is reversible, said polarity of said offset voltage in a first frame period is opposite to said polarity of said offset voltage during a second frame period, said selected grayscale voltage corresponds to color-reduced data generated through color-reduction of said input display data, said color reduction is achieved by using a frame rate control error value selected from a set of $2^n$ values during one frame period, where n is an integer greater than zero, said data signal is output to a specific pixel from among said plurality of pixels and a polarity of said data signal is switched across different frame periods, and said data signal is output to said specific pixel based on a unique combination of said polarity of data signal, said polarity of said offset voltage, and said frame rate control error value during one frame period, and said unique combination repeats every $2^n \times 2 \times 2$ frame periods for said specific pixel.

2. The display device according to claim 1, wherein a polarity of the data signal fed to a pixel from among the plurality of pixels is inverted every frame period, and said polarity of said offset voltage of said amplifier is inverted every two frame period.

3. The display device according to claim 1, wherein each of said plurality of data drivers receives said color-reduced data generated through color-reduction of said input display data.

4. The display device according to claim 3, wherein said unique combination repeats every $2^n \times 2 \times 2$ frame periods for said specific pixel so that all the possible combinations of said polarity of said data signal, said polarity of said offset voltage, and said frame rate control error value used for said color reduction are covered in a single control cycle that repeats every $2^n \times 2 \times 2$ frame periods for said specific pixel.

5. The display device according to claim 4, wherein said polarity of said data signal is inverted every frame period, wherein said frame rate control error value used for said color reduction is controlled at a cycle of $2^n \times 2$ frame period, and wherein polarities of said offset voltage in first to $(2^n \times 2)$-th frame period in the former half of said control cycle are opposite to those of said offset voltage of said amplifier used for driving said specific pixel in $(2^n \times 2+1)$-th to $(2^n \times 2 \times 2)$-th frame period in the latter half of said control cycle, respectively.

6. The display device according to claim 1, wherein each of said plurality of data drivers further includes a processing circuit generating said color-reduced data, said color-reduced data generated through n-bit color-reduction of said input display data.

7. The display device according to claim 1, wherein said polarity of said offset voltage of said amplifier used for driving respective pixels in a first line is opposite to that of said offset voltage of said amplifier used for driving said respective pixels in a second line adjacent to said first line.

8. A data driver used for driving a display panel, comprising:

a grayscale voltage generator circuit generating a plurality of grayscale voltages; and a drive circuitry selecting a grayscale voltage from said plurality of grayscale voltages in response to input display data, and outputting a data signal having a voltage level corresponding to said selected grayscale voltage to said display panel;

wherein said grayscale voltage generator circuit comprises:

an amplifier generating a voltage bias including an offset voltage; and a voltage generator circuit generating said plurality of grayscale voltages from said voltage bias;

wherein:

said amplifier is configured such that a polarity of said offset voltage of said amplifier is reversible, said polarity of said offset voltage in a first frame period is opposite to said polarity of said offset voltage in a second frame period, said selected grayscale voltage corresponds to color-reduced data generated through color-reduction of said input display data, said color reduction is achieved by using a frame rate control error value selected from a set of $2^n$ values during one frame period, where n is an integer greater than zero, said data signal is output to a specific and a polarity of said data signal corresponding to said specific pixel is switched across different frame periods, and said data signal is output to said specific pixel based on a unique combination of said polarity of data signal, said polarity of said offset voltage, and said frame rate control error value during one frame period, and said unique combination repeats every $2^n \times 2 \times 2$ frame periods for said specific pixel.

9. The display device according to claim 8, further comprising:

a processing circuit generating said color-reduced data through n-bit color-reduction of said input display data.

10. The data driver according to claim 9, wherein said unique combination repeats every $2^n \times 2 \times 2$ frame periods for said specific pixel so that all the possible combinations of said polarity of said data signal fed to said specific pixel, said polarity of said offset voltage and said frame rate control error value used for said color reduction are covered in a single control cycle that repeats every $2^n \times 2 \times 2$ frame periods for said specific pixel.

11. The data driver according to claim 8, wherein said data driver receives said color-reduced data generated through color-reduction of said input display data.

12. The data driver according to claim 8, wherein said grayscale voltage generator circuit includes:

serially-connected resistors biased by said voltage bias; and a plurality of operation amplifiers connected with respective taps prepared on said serially-connected resistors, generating said plurality of grayscale voltages, respectively.

13. A display panel drive method comprising:

generating a voltage bias including an offset voltage by an amplifier configured such that a polarity of the offset voltage of said amplifier is reversible;

generating a plurality of grayscale voltages from said voltage bias;

selecting a grayscale voltage from said plurality of grayscale voltages in response to input display data; and driving a pixel on a display panel by feeding a data signal having a voltage level corresponding to said selected grayscale voltage to said pixel, wherein:

said polarity of said offset voltage in a first frame period is opposite to said polarity of said offset voltage, said selected grayscale voltage corresponds to color-reduced data generated through color-reduction of said input display data, said color reduction is achieved by using a frame rate control error value selected from a set of $2^n$ values during one frame period, where n is an integer greater than zero, a polarity of said data signal is switched across different frame periods, and said data signal is output to said pixel based on a unique combination of said polarity of data signal, said polarity of said offset voltage, and said frame rate control error value during one frame period, and said unique combination repeats every $2^n \times 2 \times 2$ frame periods for said pixel.

* * * * *

UNITED STATES PATENT AND TRADEMARK OFFICE

CERTIFICATE OF CORRECTION

PATENT NO. : 7,936,328 B2
APPLICATION NO. : 11/676189
DATED : May 3, 2011
INVENTOR(S) : Hirobumi Furihata, Takashi Nose and Kouichi Nishimura It is certified that error appears in the above-identified patent and that said Letters Patent is hereby corrected as shown below:

In the Specifications:

Column 7, Line 7: delete "$V_L$, and $V_H$" and insert -- $V_L^-$, and $V_H^-$ --

Column 7, Line 9: delete "$V_L$" and insert -- $V_L^-$ --

Column 7, Line 10: delete "$V_L$" and insert -- $V_L^-$ --

Column 10, Line 33: delete "$36_2$, $36_2$, $37_2$, and $37_2$" and insert -- $36_1$, $36_2$, $37_1$, and $37_2$ --

Column 11, Line 52: delete "$37_2$ and $37_2$" and insert -- $37_1$ and $37_2$ --

Signed and Sealed this
Seventh Day of May, 2013

Teresa Stanek Rea
*Acting Director of the United States Patent and Trademark Office*